US012661703B2

(12) United States Patent
Dittrich

(10) Patent No.: US 12,661,703 B2
(45) Date of Patent: Jun. 23, 2026

(54) SYSTEMS, APPARATUS, AND METHODS OF ADJUSTABLY BUILDING REBAR STRUCTURE

(71) Applicant: Builders FirstSource, Inc., Irving, TX (US)

(72) Inventor: Shane Christopher Dittrich, Nampa, ID (US)

(73) Assignee: Builders FirstSource, Inc., Irving, TX (US)

( * ) Notice: Subject to any disclaimer, the term of this patent is extended or adjusted under 35 U.S.C. 154(b) by 0 days.

(21) Appl. No.: 17/656,098

(22) Filed: Mar. 23, 2022

(65) Prior Publication Data

US 2022/0305544 A1 Sep. 29, 2022

Related U.S. Application Data

(60) Provisional application No. 63/165,596, filed on Mar. 24, 2021.

(51) Int. Cl.
*B21D 43/00* (2006.01)
*E04C 5/06* (2006.01)

(52) U.S. Cl.
CPC ..... *B21D 43/006* (2013.01); *E04C 5/0622* (2013.01)

(58) Field of Classification Search
CPC ... B21D 43/006; E04C 5/0622; B21F 23/005; B21F 27/08; B21F 27/10; B21F 23/002; B21F 27/125
See application file for complete search history.

(56) References Cited

U.S. PATENT DOCUMENTS

2013/0313302 A1* 11/2013 Tsai ..... B21F 23/005 226/196.1
2018/0236527 A1* 8/2018 Davoodi ..... B21F 27/122

FOREIGN PATENT DOCUMENTS

CN 108284179 A * 7/2018 ..... B21F 23/00
DE 29714109 U1 * 10/1997
EP 1356875 A2 * 10/2003 ..... B21D 43/006
(Continued)

OTHER PUBLICATIONS

International Search Report and Written Opinion dated Jul. 8, 2022 for international application PCT/US2022/071285.

*Primary Examiner* — Gene O Crawford
*Assistant Examiner* — Abby A Jorgensen
(74) *Attorney, Agent, or Firm* — Alston & Bird LLP

(57) ABSTRACT

Feed segments within an adjustable feed matrix may be vertically adjusted, horizontally adjusted, and adjusted for rebar thickness. The adjustable feed matrix may be used in rebar structure building. A feed column may include a plurality of feed segments. Each feed segment may include a feed input and a feed output connected by a feed cavity. The feed cavity can include a feed mechanism and/or stabilizing mechanism that allows different thicknesses of rebar to consistently pass through the feed segment to the feed output. A vertical adjustment may adjust vertical spacing of the segments and increase or decrease vertical spacing of the feed outputs, enabling different vertical spacing between rebar passing through segments of the feed column. The feed column may attach to a rail through a coupling. The coupling may be released through a horizontal adjustment, enabling the feed column to slide along the rail and adjust horizontal spacing of the feed outputs.

20 Claims, 21 Drawing Sheets

(56) References Cited

FOREIGN PATENT DOCUMENTS

| | | | | | |
|---|---|---|---|---|---|
| EP | 1428592 | A1 | * | 6/2004 | ..... B21B 39/002 |
| WO | WO-87/05544 | A1 | | 9/1987 | |
| WO | WO-8705544 | A | * | 9/1987 | |
| WO | WO-2006119595 | A1 | * | 11/2006 | ..... B21F 27/125 |
| WO | WO-2007043089 | A1 | * | 4/2007 | ..... B21D 43/006 |
| WO | WO-2011158269 | A2 | * | 12/2011 | ..... B21F 27/10 |
| WO | WO-2020081822 | A1 | * | 4/2020 | ..... B25B 11/02 |

* cited by examiner

SYSTEMS, APPARATUS, AND METHODS OF ADJUSTABLY BUILDING REBAR STRUCTURE

RELATED APPLICATIONS

The present application claims the benefit of priority under 35 U.S.C. § 119(e) of U.S. Provisional Patent Application No. 63/165,596 entitled SYSTEMS, APPARATUS, AND METHODS OF ADJUSTABLY BUILDING REBAR STRUCTURE, filed Mar. 24, 2021, which is hereby incorporated herein by reference in its entirety.

TECHNICAL FIELD

The present disclosure relates to rebar construction and more specifically to adjustable assembling or building of rebar structure.

BACKGROUND

Rebar is a common name for a reinforcing bar that strengthens concrete. The rebar helps the concrete by distributing tension stress, which helps limit cracking or breaking. Rebar is made from different grades and alloys of steel and often includes ridges. When concrete is poured over the rebar, the ridges help the concrete that surrounds the rebar to adhere to the rebar.

DETAILED DESCRIPTION

Figure 1:
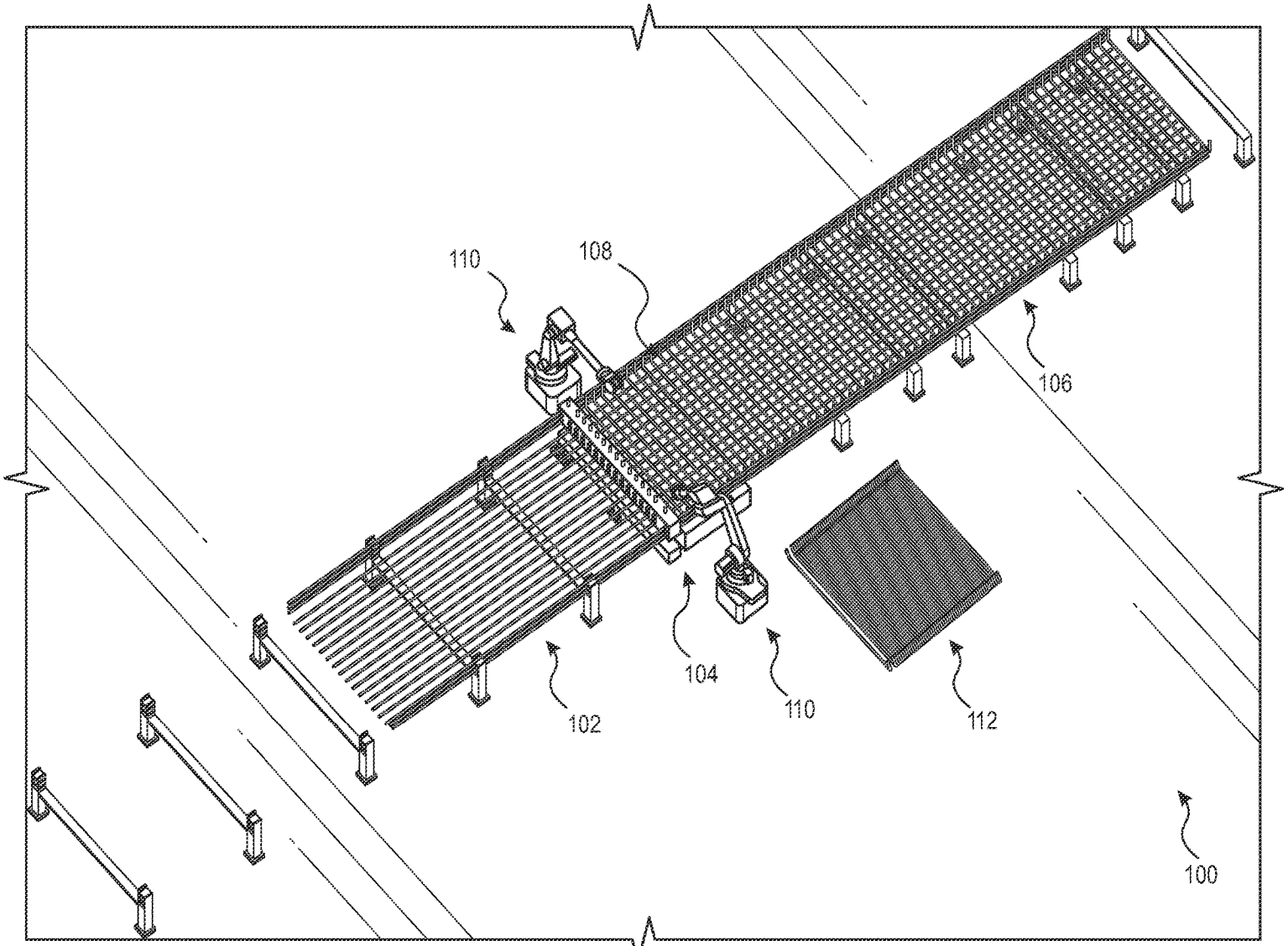
FIG. 1 shows a perspective view of a robotic rebar structure building system, according to one embodiment of the present disclosure.

A detailed description of systems and methods consistent with embodiments of the present disclosure is provided below. While several embodiments are described, it should be understood that the disclosure is not limited to any one embodiment, but instead encompasses numerous alternatives, modifications, and equivalents. In addition, while numerous specific details are set forth in the following description in order to provide a thorough understanding of the embodiments disclosed herein, some embodiments can be practiced without some or all of these details. Moreover, for the purpose of clarity, certain technical material that is known in the related art has not been described in detail in order to avoid unnecessarily obscuring the disclosure.

Techniques, apparatus, and methods are disclosed that enable a vertical adjustment, horizontal adjustment, and/or rebar thickness adjustment of feed columns within an adjustable feed matrix used in rebar structure building. The feed column may include a plurality of feed segments. Each feed segment may include a feed input and a feed output connected by a feed cavity. The cavity may comprise a rebar support to direct a length of feed rebar from the feed input to the feed output. Within the feed cavity may be a rebar feed (e.g., feed mechanism and/or stabilizing mechanism) that allows different thicknesses of rebar to consistently pass through the feed segment to the feed output. A vertical adjustment may adjust vertical spacing of the segments and increase or decrease vertical spacing of the feed outputs, enabling different vertical spacing between rebar passing through segments of the feed column. The feed column may attach to a rail through a coupling. The coupling may be released through a horizontal adjustment, enabling the feed column to slide along the rail.

Multiple feed columns may be combined to form an adjustable feed matrix. The feed columns may be individually horizontally adjustable along a rail by using the horizontal adjustment mechanism of each column. The vertical spacing of feed segments of the feed columns may be individually adjusted by using the vertical adjustment mechanism of each column. Various sizes of rebar may be passed through feed segments that adapt to the size of the rebar. That rebar, which may be called feed rebar, may be coupled with one or more cross rebar to form rebar structures.

Robotic arms may be used to place and couple the cross rebar to the feed rebar. The feed rebar may be fed through the adjustable feed matrix. A first arm may lay a cross rebar across the feed rebar. The first arm and a second arm may then couple the cross rebar to the feed rebar, such as through tying or welding. This cross rebar coupling to feed rebar may be repeated along a configured length(s) of the feed rebar.

The robotic arms may be configured to couple cross rebar above, below and to both sides of the feed rebar, forming a cage. By coupling cross rebar around the feed rebar, an enclosed cage is able to be formed. By raising the feed rebar away from a floor, and placing robotic arms to the sides of the feed rebar, each arm may reach underneath, above, and to the respective sides of the feed rebar to form the cage.

The robotic arms and feed matrix may be combined with a control system in a mobile rebar structure construction system. For example, a control system room and a robot room may be configured within a shipping container that may be transported by a truck. The container may include an input side from which feed rebar is fed through the feed matrix, and an output side from which a rebar structure emerges. The rebar construction system may also include supports that enable long pieces of rebar to be used for the feed rebar. The rebar construction system may also include a cross rebar feeding mechanism that holds and/or receives cross rebar from which a first robotic arm may retrieve cross rebar.

Depending on the embodiment, the system may be configured in a manual, partially automated, or fully automated configuration. The adjustable feed matrix, placement of cross rebar, coupling of feed rebar to cross rebar, and/or movement of the feed rebar through the adjustable feed matrix may be manual, partially automated, or fully automated.

FIG. 1 shows a perspective view of a robotic rebar structure building system 100, according to one embodiment of the present disclosure. Rebar 102 may be fed through an adjustable feed matrix 104 that provides an outline of a rebar structure 106. Cross rebar 108 may be coupled (e.g., tied, welded, etc.) to the rebar structure 106 by robotic arms 110 at defined intervals.

The adjustable feed matrix 104 and robotic arms 110 enable quick configuration of various rebar structures 106. The adjustable feed matrix 104 enables rebar to be consistently held at configurable heights and widths from other rebar 102. This holding of rebar 102 by adjustable feed matrix 104 enables cross rebar 108 to be placed and coupled to the rebar 102 that has passed through the feed matrix 104. Once the cross rebar 108 is coupled, the rebar structure 106 gains rigidity to be transported as one piece.

For example, an adjustable feed matrix 104 may be configured to deliver the feed rebar 102 in a U-shape arrangement (e.g., the ends of the feed rebar 102 are arranged relative to each other to form a U-shape). The arrangement may correspond to a shape of cross rebar 108. As the feed rebar 102 is fed through the adjustable feed matrix 104, cross rebar 108 may be obtained from a cross rebar stack 112 and laid across the feed rebar 102 exiting the adjustable feed matrix 104. Robotic arms may couple (e.g., tie or weld) the cross rebar 108 to the feed rebar 102 to form the rebar structure 106. The placement and coupling of the cross rebar 108 to the feed rebar 102 may be repeated at configurable intervals. Once complete, the rebar structure may be transported to a build site where concrete may be poured over the rebar structure.

Figure 2:
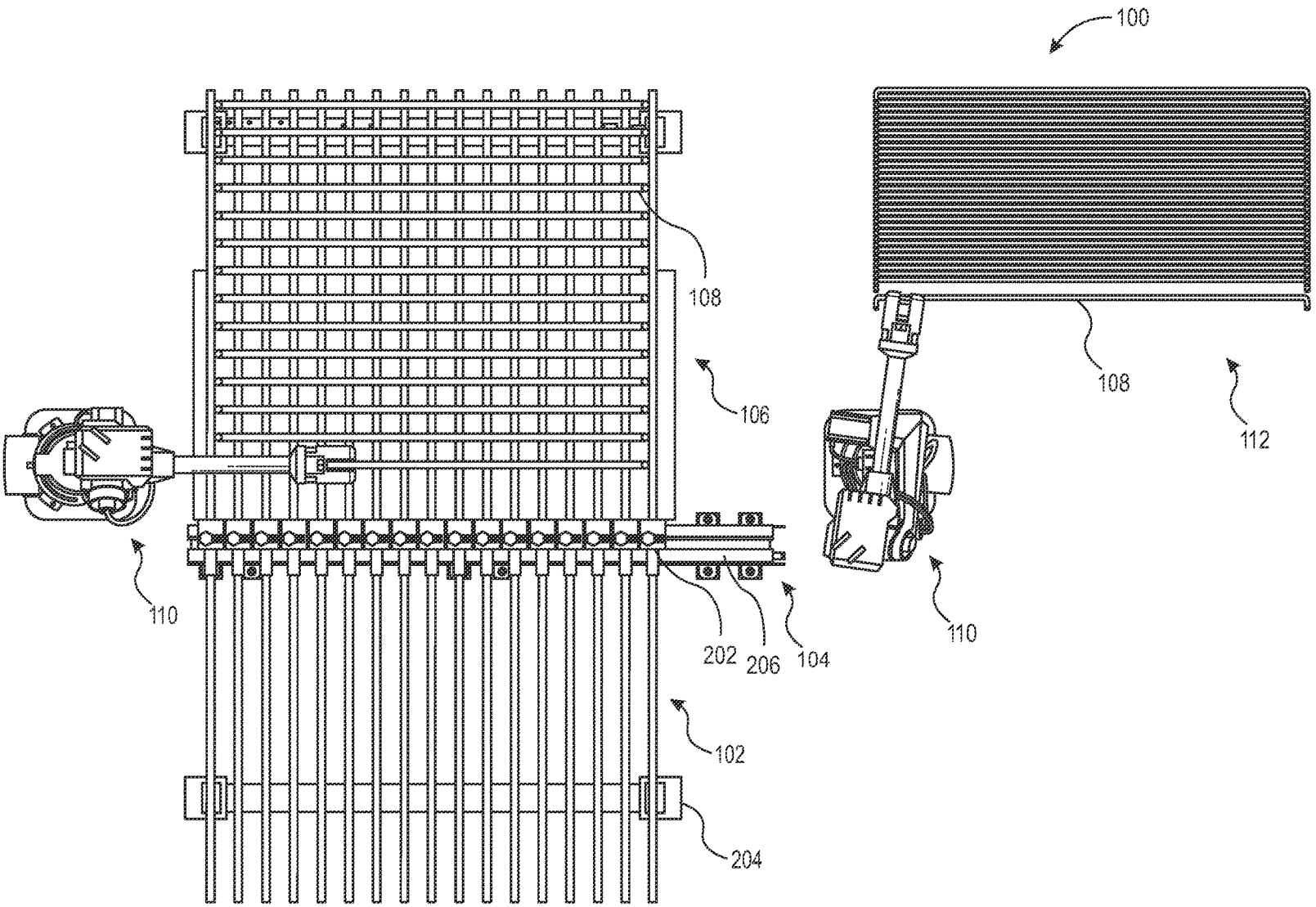
FIG. 2 shows a top view of a robotic rebar structure building system, according to one embodiment of the present disclosure.

FIG. 2 shows a top view of a robotic rebar structure building system 100, according to one embodiment of the present disclosure. The adjustable feed matrix 104 may comprise one or more feed columns 202 that hold feed rebar 102 at various heights and widths that enables one or more crossbar positioners (e.g., robotic arms) 110 to place and/or couple cross rebar 108 to the feed rebar 102 to form a rebar structure 106. Feed rebar 102 may be held by one or more supports 204 as the feed rebar 102 is drawn or pushed through the adjustable feed matrix 104. A crossbar positioner (e.g., a robotic arm) 110 may select a cross rebar 108 from a cross rebar stack 112 before placing the cross rebar 108 for coupling to the feed rebar 102.

The adjustable feed matrix 104 enables building of customized rebar structures 106. For example, feed columns 202 can be set for widths and heights of a first rebar structure. The feed rebar 102 may be placed into the adjustable feed matrix 104, the cross rebar stack 112 may be set up, and the robotic arms 110 may be programmed with cross rebar spacing and cross rebar coupling points at the intersection of the cross rebar 108 and feed rebar 102. The robotic arms 110 may place and/or couple the cross rebar 108 to the feed rebar 102 to form the first rebar structure.

After completing one or more first rebar structures, the feed columns 202 can be adjusted for widths and heights of a second rebar structure. The feed rebar 102 may be placed into the adjustable feed matrix 104, the cross rebar stack 112 may be set up, and the robotic arms 110 may be programmed with cross rebar spacing and cross rebar coupling points at the intersection of the cross rebar 108 and feed rebar 102. The robotic arms 110 may place and couple the cross rebar 108 to the feed rebar 102 to form one or more second rebar structures. This may be repeated for third, fourth, etc., rebar structures.

The adjustable feed matrix 104 may comprise feed columns 202 that individually couple to a rail 206. The feed columns 202 may be individually moved laterally along the rail 206 to adjust the width (horizontal) between feed rebar 102.

In some embodiments, the adjustable feed matrix 104 may be used with a manual system rather than an automated system. For example, the adjustable feed matrix 104 may be horizontally and vertically adjusted manually. The feed rebar 102 may be pushed or pulled through the adjustable feed matrix 104. The cross rebar 108 may be manually coupled to feed rebar 102. Depending on the embodiment, the system may be configured in a manual, partially automated, or fully automated configuration.

Figure 3:
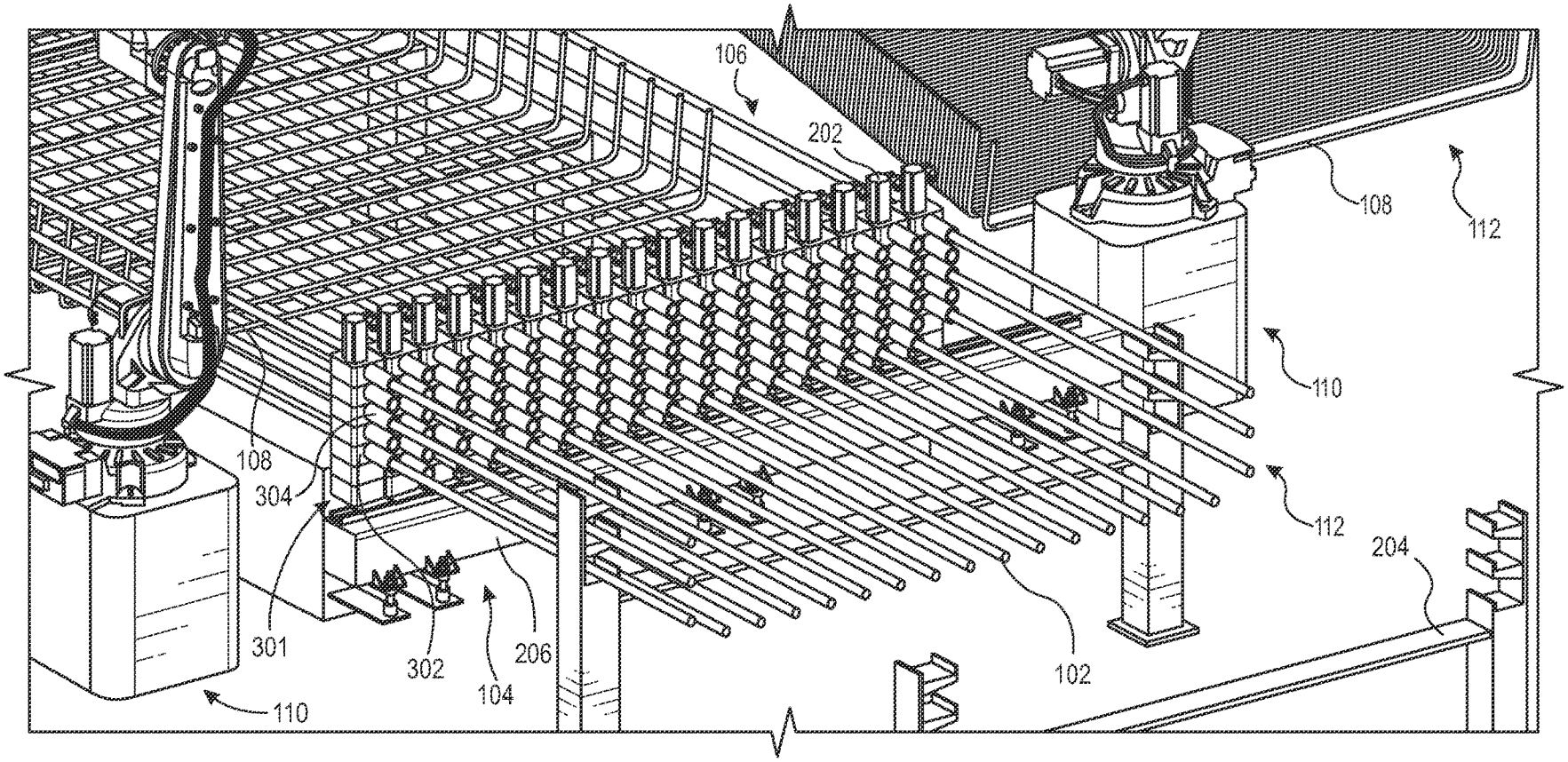
FIG. 3 shows a perspective view of feeding mechanisms of a robotic rebar structure building system, according to one embodiment of the present disclosure.

FIG. 3 shows a perspective view of feeding mechanisms 301 of a robotic rebar structure building system, according to one embodiment of the present disclosure. Feed rebar 102 aided by supports 204 may be fed into feed inputs 304 of feed segments 302 of feed columns 202 of the adjustable feed matrix 104. Feed columns 202 may comprise one or more feed segments 302 that include feed inputs 304. Feed inputs 304 may receive a feed rebar 102 that is passed through the feed segment 302 while kept at a consistent distance in width and/or height from feed rebar 102 in other feed inputs 304 within the adjustable feed matrix 104. The adjustable feed matrix 104 enables input rebar 102 to be held consistently within two dimensions (width and/or height). The robotic arms 110 may couple cross rebar 108 at cross rebar spacing along the feed rebar 102 to form the depth of the rebar structure 106.

Feed inputs 304 may receive varying thicknesses of feed rebar 102. Feed segments 302 enable adjustable vertical distances between feed inputs 304 within a feed column 202. The feed columns 202 may be horizontally adjustable, for example, by removably coupling to a rail 206 and sliding along the rail 206. These vertical, horizontal and thickness adjustments enable the adjustable feed matrix 104 to construct various configurations of rebar structures 106.

Figure 4:
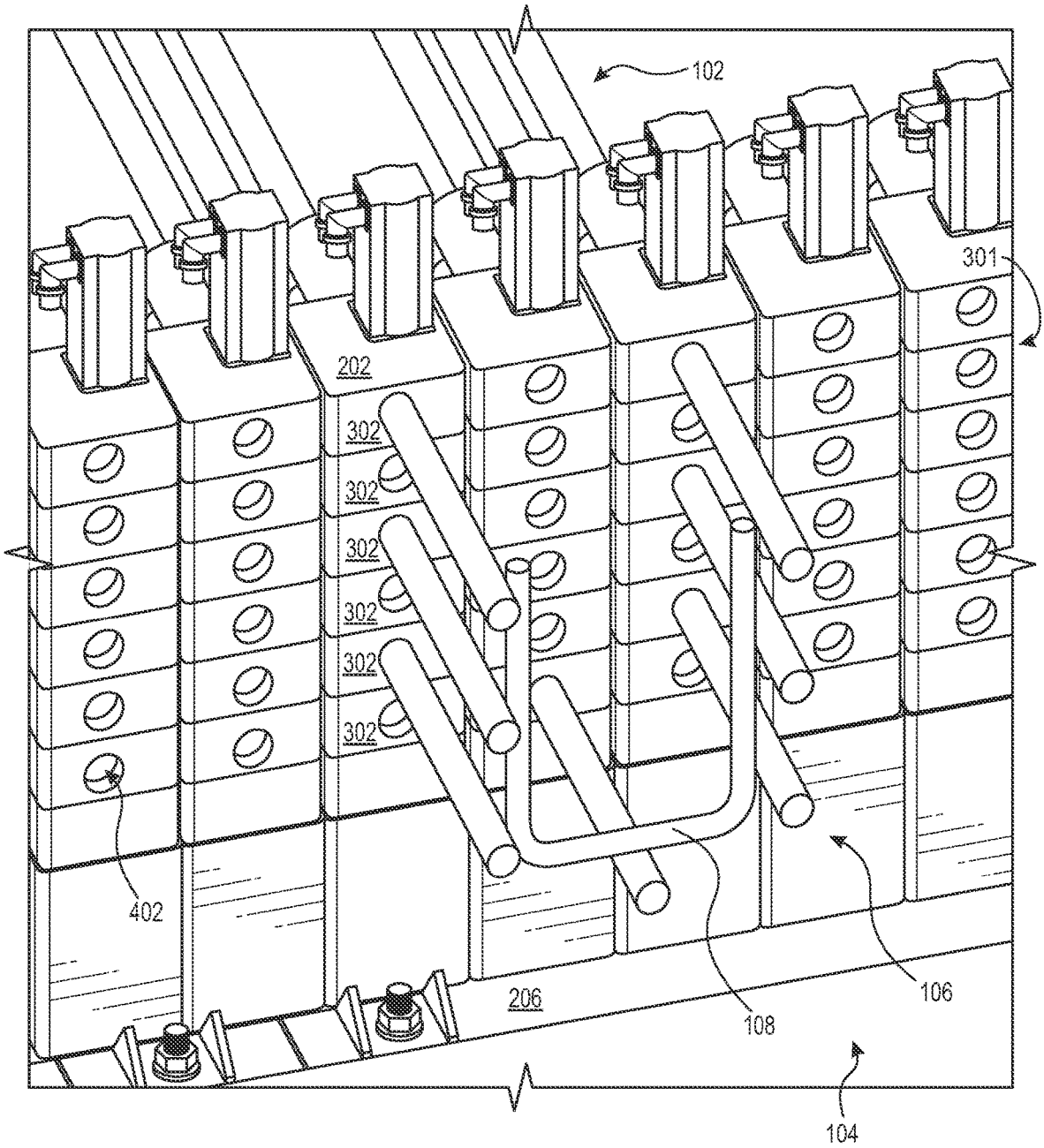
FIG. 4 shows a close-up perspective view of feeding mechanisms of a robotic rebar structure building system, according to one embodiment of the present disclosure.

FIG. 4 shows a close-up perspective view of feeding mechanisms 301 of a robotic rebar structure building system, according to one embodiment of the present disclosure. Feed rebar 102 may be fed through the feed matrix 104 to set a width and height of the rebar structure 106. Feed outputs 402 of the feed matrix 104 may be used to form various geometrical arrangements or designs of the rebar structure 106. At configured intervals, a plurality of cross rebar 108 may be coupled in a direction transverse to the feed rebar 102 to form and define (or further define) a depth (or other further dimension) of the rebar structure 106.

The feed matrix 104 may comprise a plurality of feed columns 202 that are horizontally adjustable. The feed columns 202 may comprise one or more feed segments 302 that may be vertically adjustable with respect to other feed segments 302 in the feed column 202. Depth of the rebar structure 106 may be controlled by the length of the feed rebar 102 fed through the feed matrix 104. Feed rebar 102 may be spliced (or otherwise joined) to increase the length, or cut to decrease the length. Rigidity of the rebar structure 106 may be at least partially controlled by an interval of cross rebar 108 coupled to the feed rebar 102 exiting through the rebar output 402 of the feed segment 302.

For example, FIG. 3 shows a wide configuration of a rebar structure. Feed rebar 102 comprises many rebar along bottom feed inputs 304 of the feed matrix 104, and three rebar along each side of the feed matrix 104. After completion of that first rebar structure 106, the feed matrix 104 may be reconfigured for a second rebar structure 106. In FIG. 4, the width of the second rebar structure 106 has been decreased to a single bottom feed rebar 102, while retaining three feed rebar 102 along each side of the feed matrix 104. This forms a more compact U-shape. The feed matrix 104 with feed columns 202 and feed segments 302, with adjustable rebar thicknesses, enables quick reconfiguration and construction on varying sizes and configurations of rebar structures 106.

Figure 5:
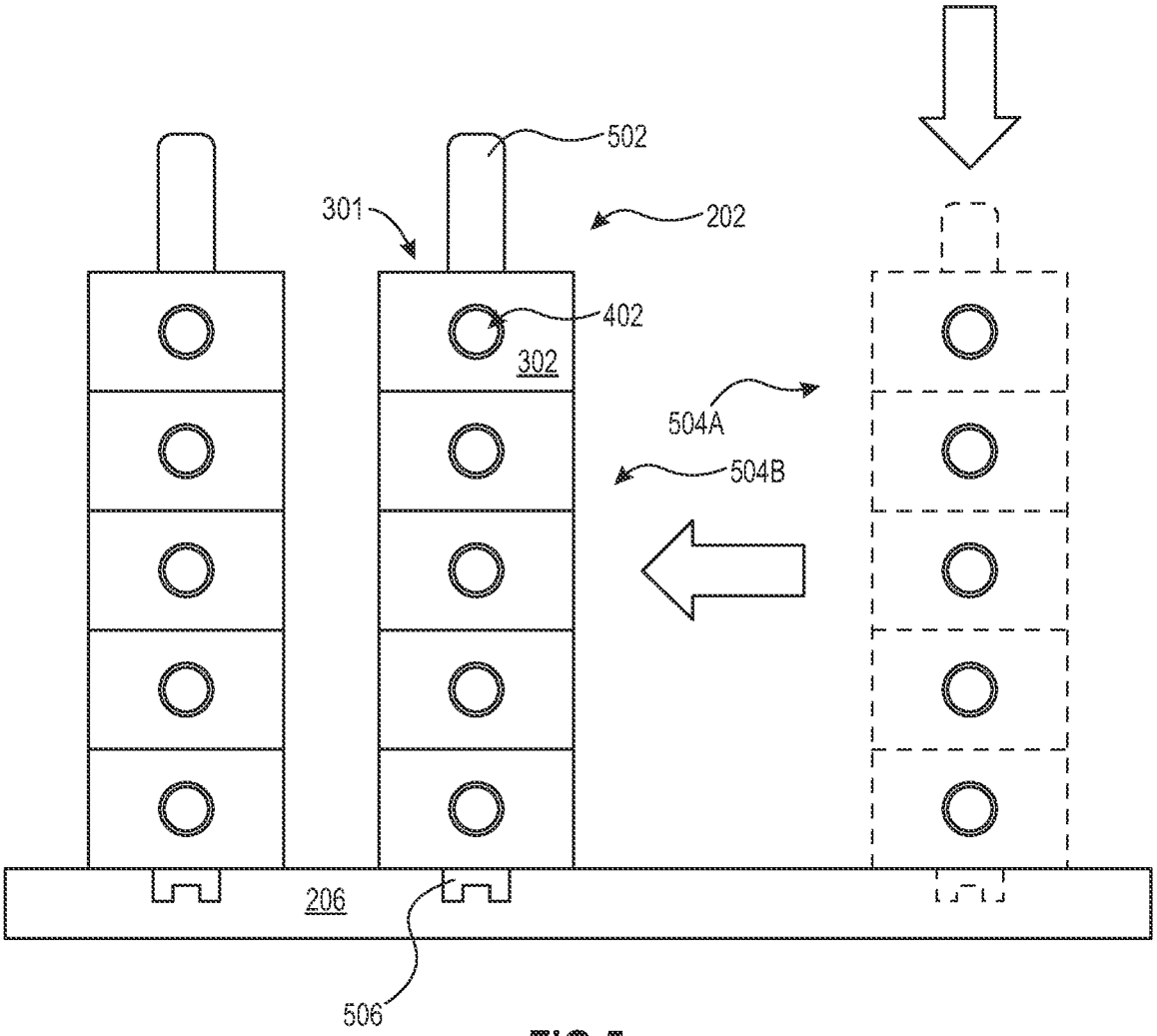
FIG. 5 shows a diagram illustrating a horizontal adjustment of a feeding mechanism of a robotic rebar structure building system, according to one embodiment of the present disclosure.

FIG. 5 shows a diagram illustrating a horizontal adjustment of feeding mechanisms 301 of a robotic rebar structure building system, according to one embodiment of the present disclosure. A feed column 202 may be moved from a first position 504A to a second position 504B using a horizontal adjustment mechanism. For example, the feed column 202 may be coupled to a rail 206 via a releasable clamp 506. Pressing down on an adjustment mechanism 502 may activate the mechanism and release (e.g., decouple) the clamp 506 from the rail 206. The feed column 202 may slide along the rail 206 (e.g., move along the rail) until it reaches position 504B. The adjustment mechanism 502 may be released (e.g., deactivated) and the releasable clamp 506 may firmly recouple to rail 206, preventing further horizontal movement. This horizontal adjustment enables a configurable width as measured between adjacent feed rebar 102.

Other horizontal adjustment mechanisms, such as hydraulics, pneumatics, electric motors, electromagnets, etc., may be used, including computer controllable versions of the described mechanical mechanisms. The horizontal adjustment mechanism may be a motor driven mechanism, mechanically moved, electromechanically moved, actuated, pneumatically moved, Servo motor driven, moved with the robotic arm or another robot, etc.

Figure 6:
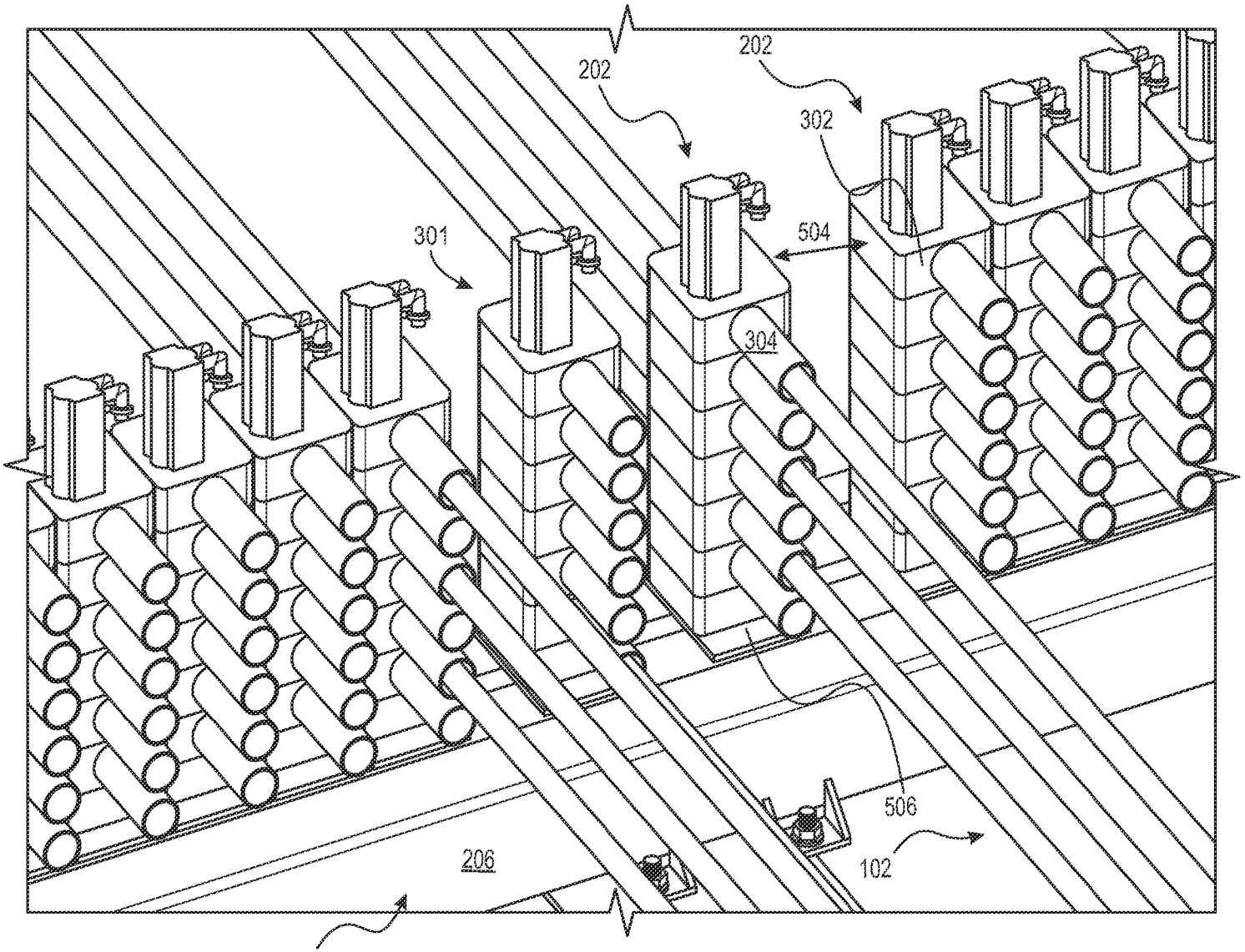
FIG. 6 shows a perspective view of feeding mechanisms having been horizontally adjusted in a robotic rebar structure building system, according to one embodiment of the present disclosure.

FIG. 6 shows a perspective view of feeding mechanisms 301 having been horizontally adjusted in a robotic rebar structure building system, according to one embodiment of the present disclosure. Each feed column 202 may be individually adjusted in a horizontal direction. This enables feed columns 202 to have varying gaps or distances 504 between them, including, in some embodiments, no gap or a very small gap. This horizontal adjustment enables varying horizontal distances between feed rebar 102 that is placed within feed inputs 304.

Figures 7A, 7B:
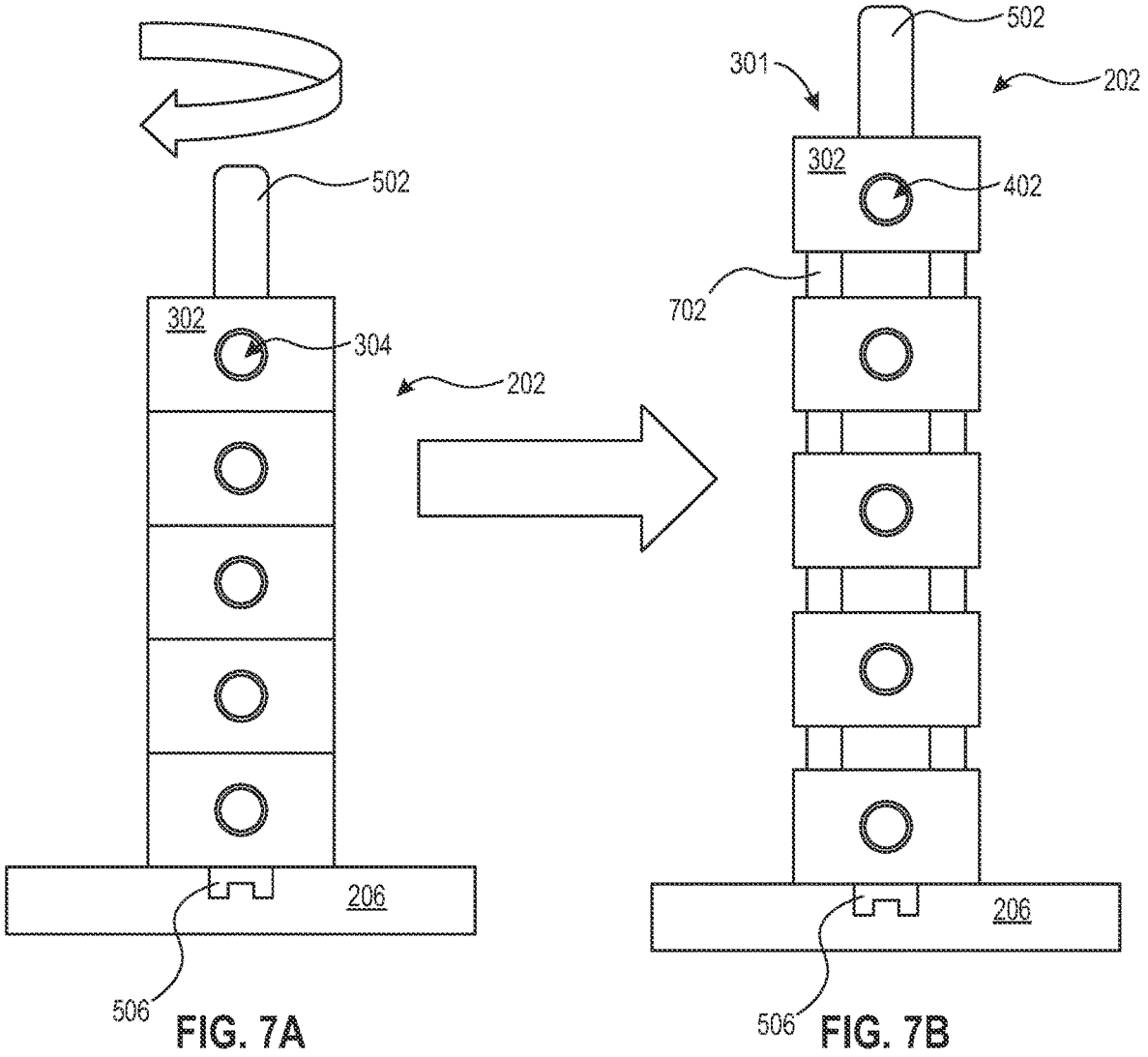
FIGS. 7A and 7B show diagrams illustrating a vertical adjustment of a feeding mechanism of a robotic rebar structure building system, according to one embodiment of the present disclosure.

FIGS. 7A and 7B show diagrams illustrating a vertical adjustment of a feeding mechanisms 301 of a robotic rebar structure building system, according to one embodiment of the present disclosure. Vertical heights of feed rebar 102 may be individually adjusted by using a vertical adjustment mechanism. The vertical adjustment mechanism may adjust feed segment 302 spacing of feed columns 202.

For example, an adjustment mechanism 502 may be turned (e.g., in a clockwise direction) to adjust a vertical position of the feed segments 302. As the adjustment mechanism 502 is turned, the vertical distance between feed segments 302 may increase as seen in a transition from FIG. 7A to FIG. 7B. In the embodiment shown, a vertical spacing adjustment mechanism may be a screw-driven mechanical drive 702 (or screw-driven mechanism) that is coupled by gears to the turnable adjustment mechanism 502. In some embodiments, the feed segments 302 are adjusted together.

In other embodiments, individual spacing between feed segments 302 may be adjusted by pressing a button that alternatively engages and disengages a gear from a main screw mechanism of the screw-driven mechanical drive 702 that runs vertically through the feed segments 302. Other vertical adjustment mechanisms, such as hydraulics, pneumatics, electric motors, electromagnets, etc., may be used, including computer controllable versions of the described mechanical mechanisms. The vertical adjustment mechanism may be a motor driven mechanism, mechanically moved, electromechanically moved, actuated, pneumatically moved, Servo motor driven, moved with the robotic arm or another robot, etc.

Figure 8:
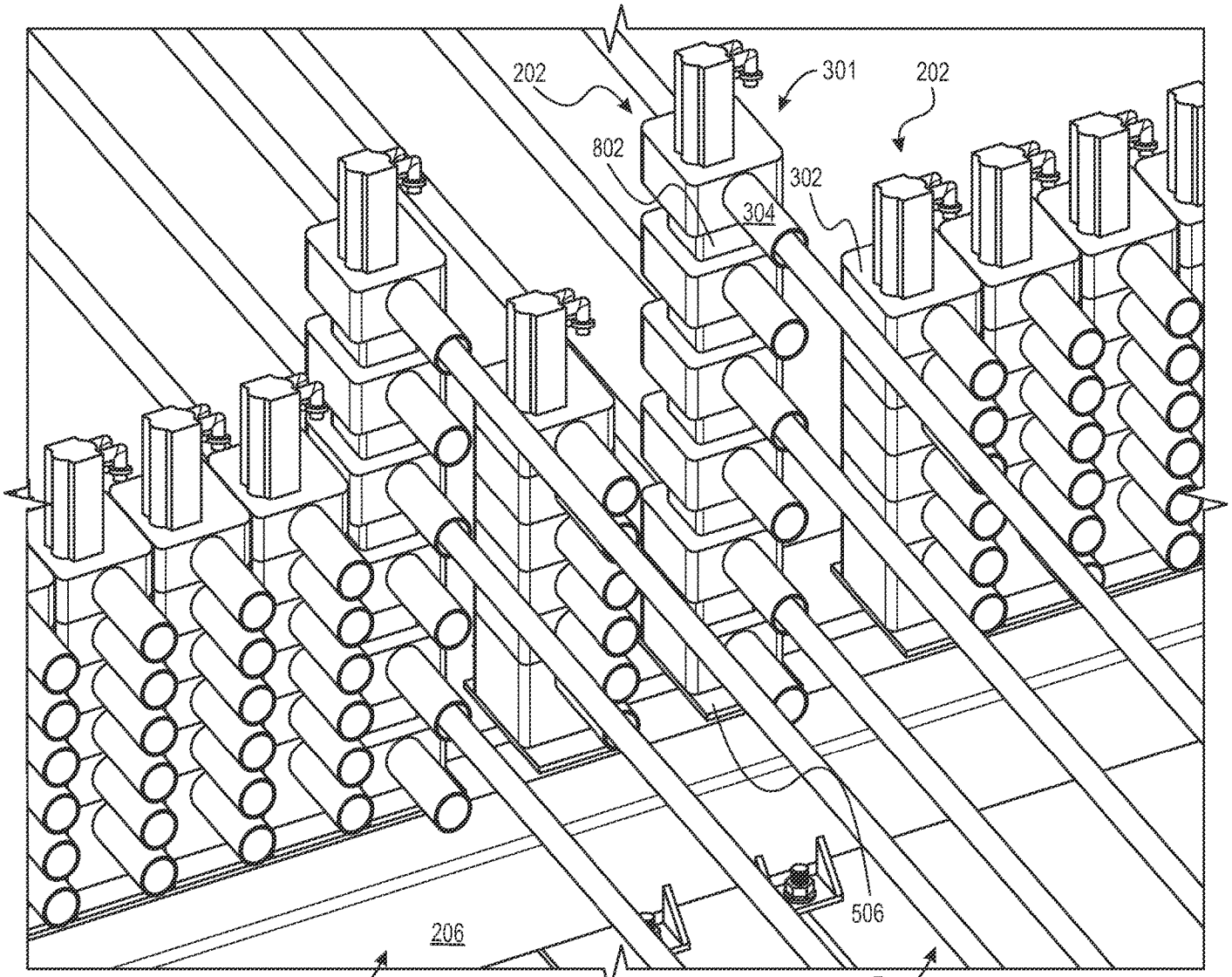
FIG. 8 shows a perspective view of feeding mechanisms having been vertically adjusted in a robotic rebar structure building system, according to one embodiment of the present disclosure.

FIG. 8 shows a perspective view of feeding mechanisms 301 having been vertically adjusted in a robotic rebar structure building system, according to one embodiment of the present disclosure. In the embodiment, a vertical adjustment comprising a computer controlled hydraulic system 802 is shown. The feed segments 302 comprise a hydraulic space that may be filled with liquid that pushes down upon a piston that is coupled to the top of another feed segment 302. Individual feed segments 302 may be addressed via internal hydraulic fluid distribution for each feed column 202. This vertical adjustment of individual feed segments enables variable vertical spacing of feed rebar 102. Variable vertical spacing of rebar allows various vertical spacing of rebar structures 106.

Figure 9A:
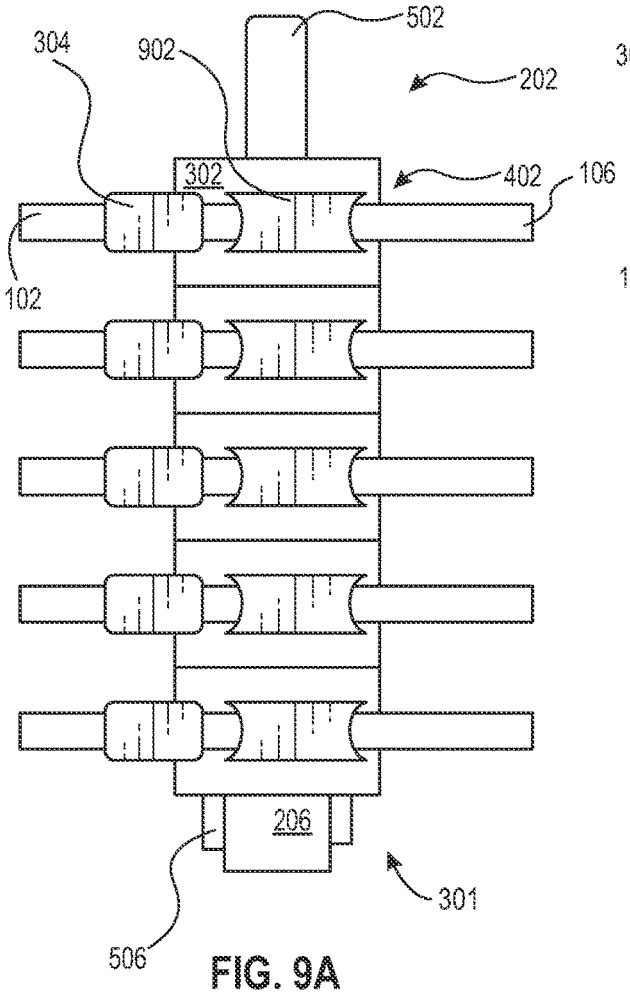
FIGS. 9A, 9B, 9C, and 9D show diagrams illustrating an adjustable feed diameter of a feeding mechanism in a robotic rebar structure building system, according to one embodiment of the present disclosure.
Figure 9C:
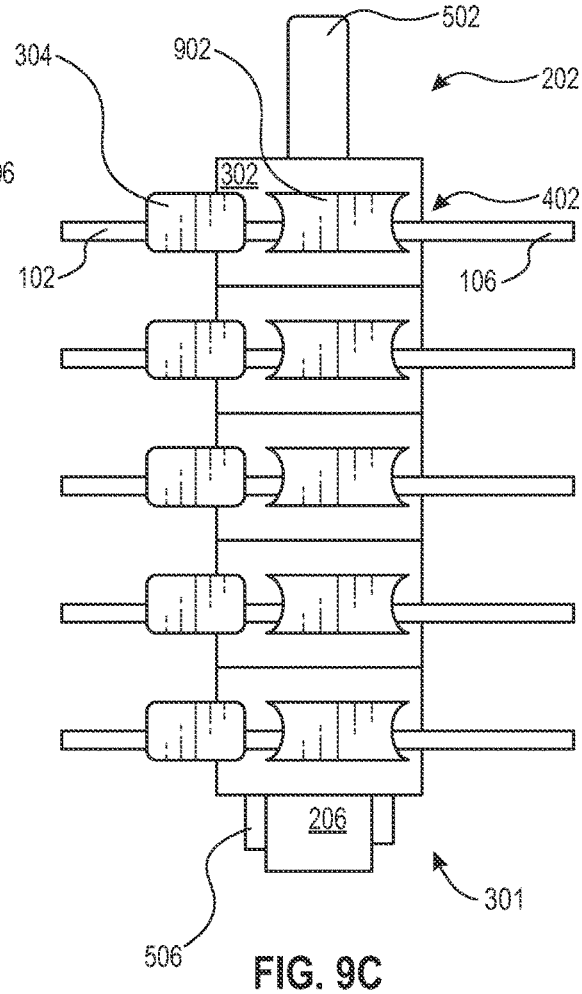
Figure 9B:
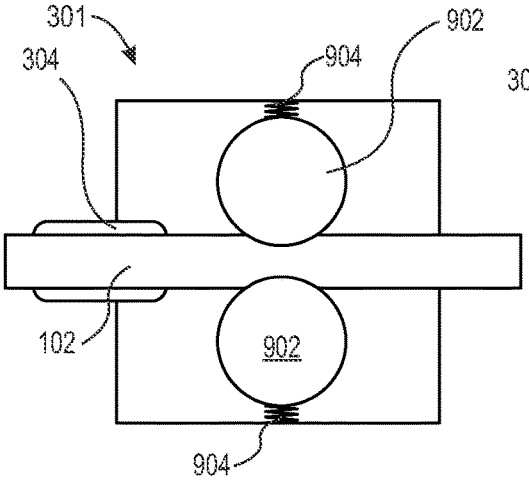
Figure 9D:
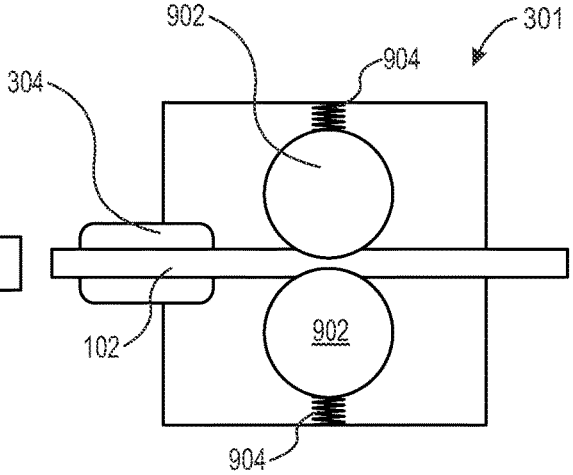

FIGS. 9A, 9B, 9C, and 9D show diagrams illustrating an adjustable feed diameter of feeding mechanisms 301 in a robotic rebar structure building system. An adjustable feeding mechanism 301 may accommodate various sizes of feed rebar 102 while reducing friction and/or firmly holding the rebar at a configurable height and width within the adjustable feed matrix 104. FIG. 9A is a side view and FIG. 9B is a top view, each showing a thicker (larger diameter or thickness) of feed rebar 102 passing through the feed segments 302. FIG. 9C is another side view and FIG. 9D is another top view, each showing a thinner (smaller diameter or thickness) of feed rebar 102 passing through the feed segments 302.

In the embodiments shown in FIGS. 9A, 9B, 9C, and 9D, feed rebar 102 passes through a rebar input 304, which may comprise a tube, cavity, or other input to a feed segment 302. Within a cavity of the feed segment 302, a stabilizing mechanism may be used to direct the feed rebar 102 to the rebar output 402 of the feed segment 302. The stabilizing mechanism may firmly hold the feed rebar 102 while reducing friction as the feed rebar 102 passes through the feed segment 302. In the embodiment shown, two discs 902 (or rollers) with concave edges rotate as the feed rebar 102 passes through the feed segment 302. The two discs 904 may be spring-loaded to enable adjustment of a distance between the discs 904 to accommodate varying thicknesses of the feed rebar 102. The discs 904 may be coupled to the feed segment 302 with bearings to enable the discs 904 to freely rotate when pressing against the feed rebar 102, reducing friction. The discs 902 may also comprise a coating that reduces vertical movement of the feed rebar 102 to limit sliding vertically, while enabling the feed rebar 102 to pass through using the rotation of the discs 902.

In some embodiments, feed segments 302 may include an automated rebar feeding that draws feed rebar 102 in and/or pushes feed rebar 102 out. For example, the stabilizing mechanism may also perform functions of the automated rebar feeding. In an embodiment, the two discs 904 are mechanically coupled to a motor, such as through a drive train, gears, etc. The two discs 904 may turn while pressing against the feed rebar 102. This enables the feed rebar 102 to be fed from the feed input 304 to the feed output 402 for a feed segment 302. When the automated feeding mechanisms are coordinated, the feed rebar 102 may be consistently fed through the adjustable feed matrix to make a consistent rebar structure.

In another embodiment, a feed segment 302 may comprise a plurality of opposing and offset discs (or rollers), for example with one or more discs on a first side of the feed rebar 102 and one or more opposing discs on an opposing second side of the feed rebar 102 and offset from the one or more discs on the first side. The plurality of opposing and offset discs may be spring-loaded to enable adjustment of a distance between the discs to accommodate varying thicknesses of the feed rebar 102.

Figure 10:
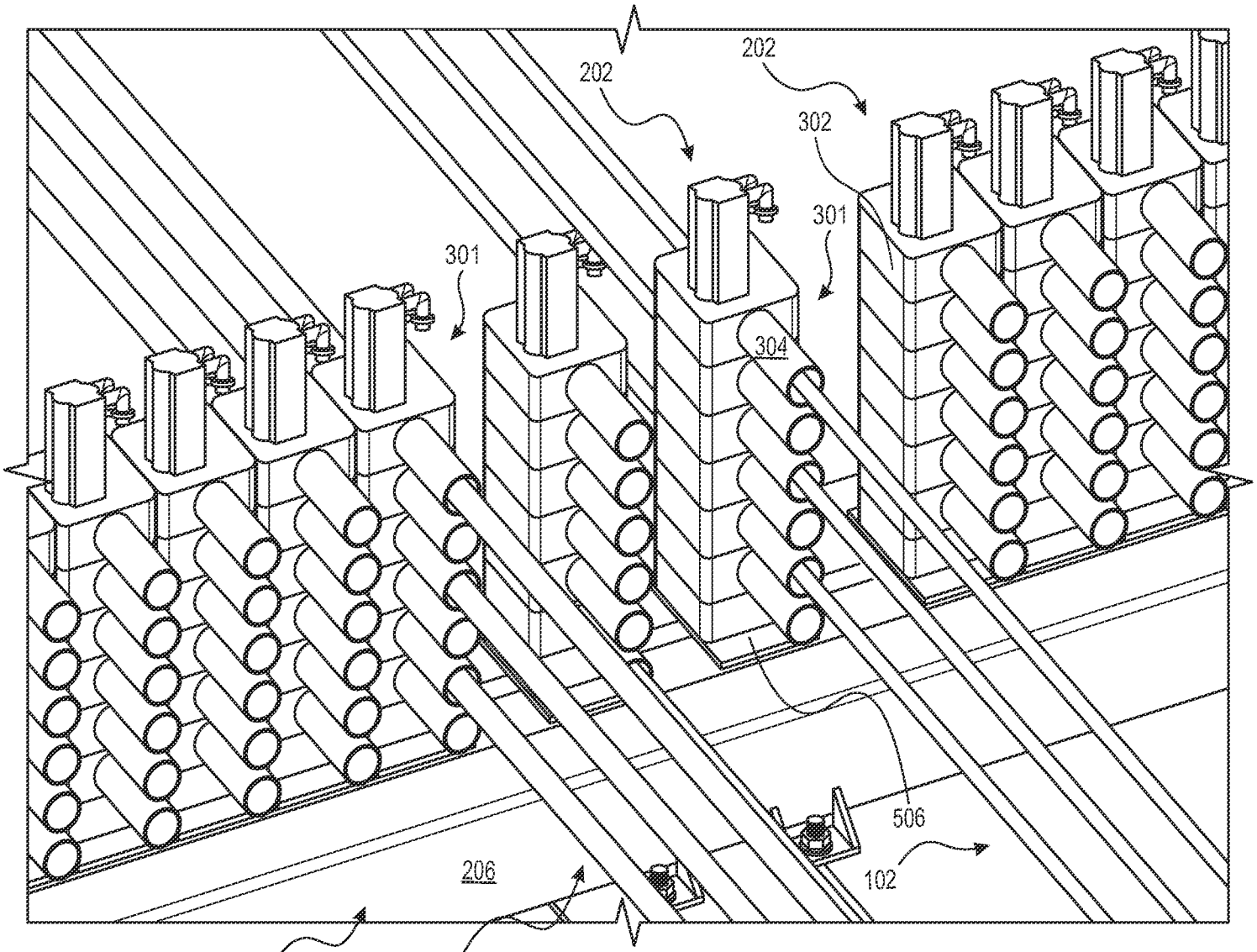
FIG. 10 shows a perspective view of feeding mechanisms having feed diameters adjusted in a robotic rebar structure building system, according to one embodiment of the present disclosure.

FIG. 10 shows a perspective view of feeding mechanisms 301 having feed diameters adjusted in a robotic rebar structure building system, according to one embodiment of the present disclosure. Feed rebar 102 may be of consistent thicknesses or varying thicknesses. The feeding mechanism of the feed segments 302 of the feed columns 202 may accommodate varying thicknesses of feed rebar 102. This enables mixed thickness construction of rebar structures 106 and/or configurable thickness of rebar structures 106.

Figure 11:
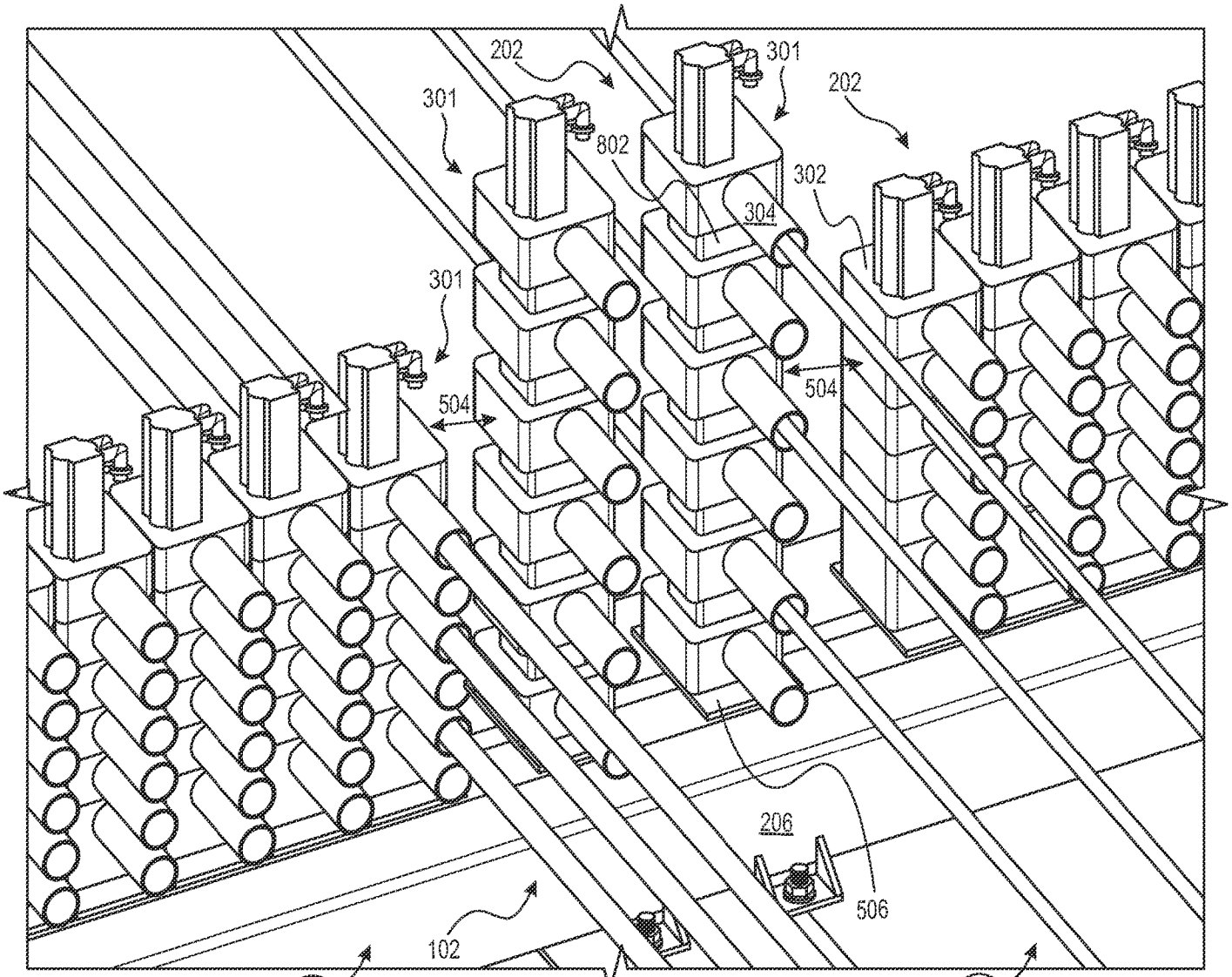
FIG. 11 shows a perspective view of feeding mechanisms having horizontal adjustments, vertical adjustments, and feed diameter adjustments in a robotic rebar structure building system, according to one embodiment of the present disclosure.

FIG. 11 shows a perspective view of feeding mechanisms 301 having horizontal adjustments, vertical adjustments, and feed diameter adjustments in a robotic rebar structure building system, according to one embodiment of the present disclosure. The horizontal adjustments, vertical adjustments, and feed diameter adjustments may be configurable in a single adjustable feed matrix 104. Feed columns 202 may be horizontally adjusted to form a distance 504 between feed columns 202. Feed segments 302 of feed columns 202 may be vertically adjusted, such as by hydraulic system 802. Various thicknesses of rebar may be accepted by feed input 304 of feed segments 302 and held firmly at a height and/or width within the adjustable feed matrix 104.

Figure 12:
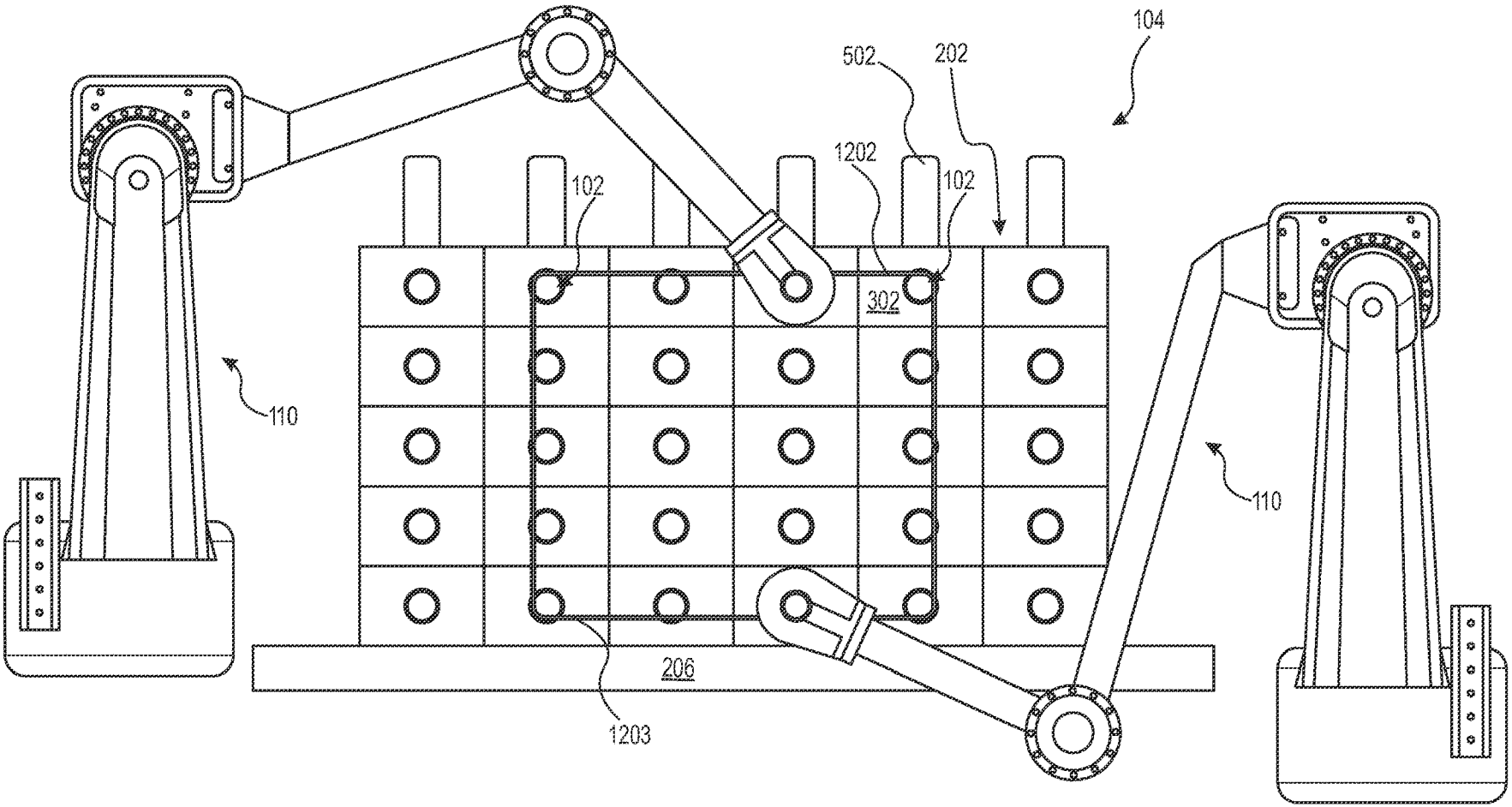
FIG. 12 shows a front view illustrating cage construction using a robotic rebar structure building system, according to one embodiment of the present disclosure.

FIG. 12 shows a front view illustrating cage construction using a robotic rebar structure building system 100, according to one embodiment of the present disclosure. The system may build a rebar structure lattice with an enclosed center. In the example shown, robotic arms 110 may place a first cross rebar 1202 and a second cross rebar 1203 around feed rebar 102. The robotic arms 110 may couple the first cross rebar 1202 and the second cross rebar 1203 to the feed rebar 102. By coupling these sets of first cross rebar 1202 and second cross rebar 1203 at configurable lengths, the system may construct an enclosed lattice rebar structure.

In some embodiments, this enclosed lattice (e.g., cage) construction is enabled by the robotic arms 110 having access and capability of coupling in multiple directions. Underneath the feed rebar 102, a robotic arm 110 may be able to couple cross rebar 1203 to the feed rebar 102 in an upward direction. Above the feed rebar 102, the robotic arm 110 may be able to couple cross rebar 1202 to the feed rebar 102 in a downward direction. To the side of the feed rebar 102, the robotic arm 110 may be able to couple cross rebar 1202,1203 to the feed rebar 102 in a sideways direction. This reach and directional coupling may enable enclosed lattice rebar structure construction.

Enclosed lattice rebar structures may be made in various sizes, shapes, and/or configurations. While the adjustable feed matrix 104 has been shown to make U shaped extrusions in FIGS. 3, 4; H shaped extrusions in FIGS. 6, 8, 10; rectangular shaped extrusions in FIG. 12; and other shaped extrusions in FIG. 11, many other configurations are possible. For example, the feed rebar 102 may be shaped in enclosed triangular forms, open angular forms, enclosed circular or oval forms, open semicircular forms, combinations or variations of any of the preceding shapes, and other shapes, based on the placement of feed rebar 102 within the adjustable feed matrix 104.

Figure 13:
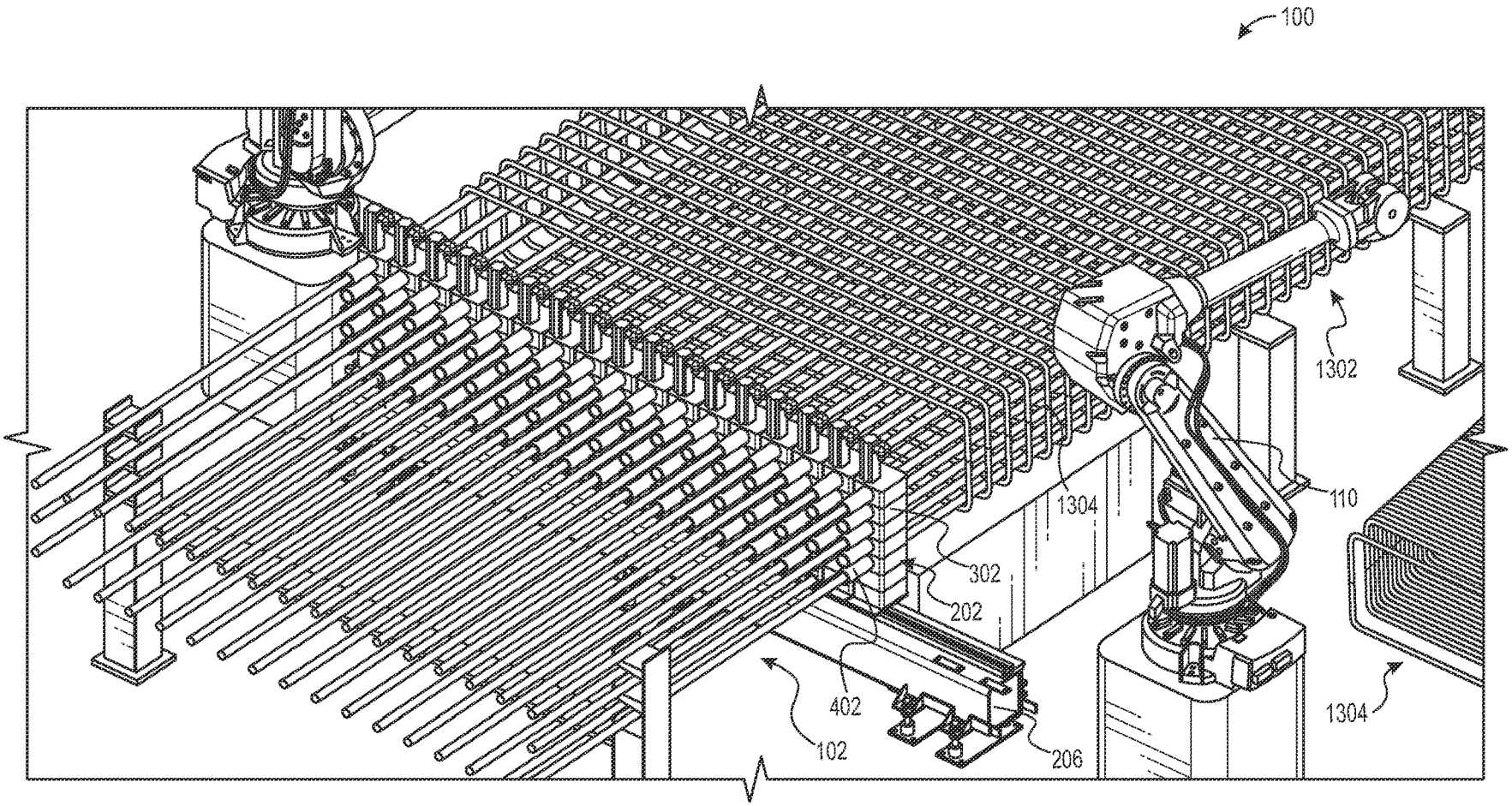
FIG. 13 shows a perspective view illustrating cage construction using a robotic rebar structure building system, according to one embodiment of the present disclosure.

FIG. 13 shows a perspective view illustrating cage construction using a robotic rebar structure building system 100, according to one embodiment of the present disclosure. Feed rebar 102 may be fed through the adjustable feed matrix comprising feed columns 202 that comprise feed segments 302. The feed rebar 102 may outline an enclosed shape. At configured intervals, cross rebar sets 1304 may be placed around the feed rebar 102.

Depending on the embodiment, the cross rebar sets 1304 may be placed manually, automatically, and/or by one or more robotic arms 110. The one or more robotic arms 110 may also, depending on the embodiment, couple the cross rebar sets 1304 to the feed rebar 102. An enclosed rebar structure 1302 may be created by this process.

Building an enclosed rebar structure 1302 in this manner with an adjustable feed matrix may provide several advantages. As the feed rebar 102 is held in place, manual movement of rebar and cross rebar is minimized, reducing time and effort. Rotation of a partially built rebar structure to couple additional feed rebar is reduced, reducing effort and risk. As the construction using the adjustable feed matrix reduces the number of tasks (e.g., reducing rotation and placement), while increasing the repeatable number of tasks, automation becomes easier and use of robotic arms may increase efficiency.

Figure 14:
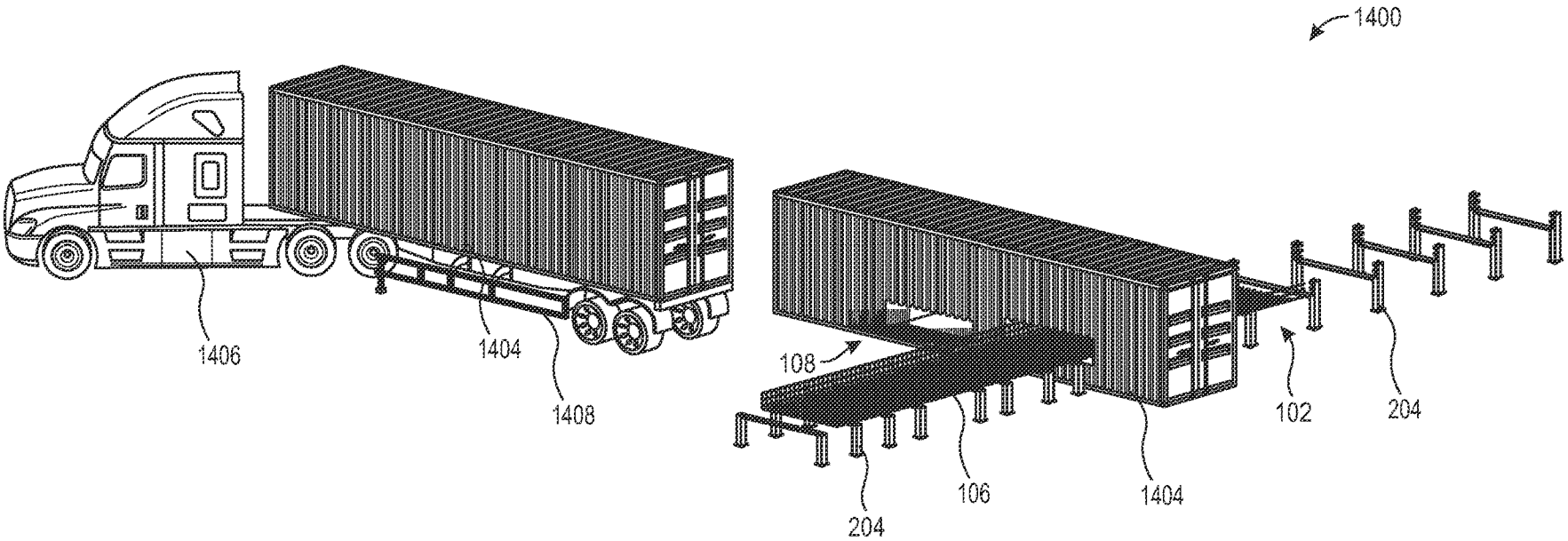
FIG. 14 shows a diagram illustrating a mobile robotic rebar structure building system, according to one embodiment of the present disclosure.

FIG. 14 shows a diagram illustrating a mobile robotic rebar structure building system 1400, according to one embodiment of the present disclosure. The mobile robotic rebar structure building system 1400 may be placed inside and/or be enclosed within a structure 1404 (e.g., enclosure), such as a shipping container, and transported via truck 1406 and trailer 1408. The system may be unloaded at or near a construction site requiring rebar structures 106. The structure 1404 may be unloaded from the trailer 1408, such as a tilt trailer, and set up to work on-site. Supports 204 may be used to guide feed rebar 102 into the structure 1404. Supports 204 may also be used to receive and support rebar structures 106 exiting the structure 1404. Cross rebar 108 may be fed in through the side of the structure 1404 as well.

Figure 15:
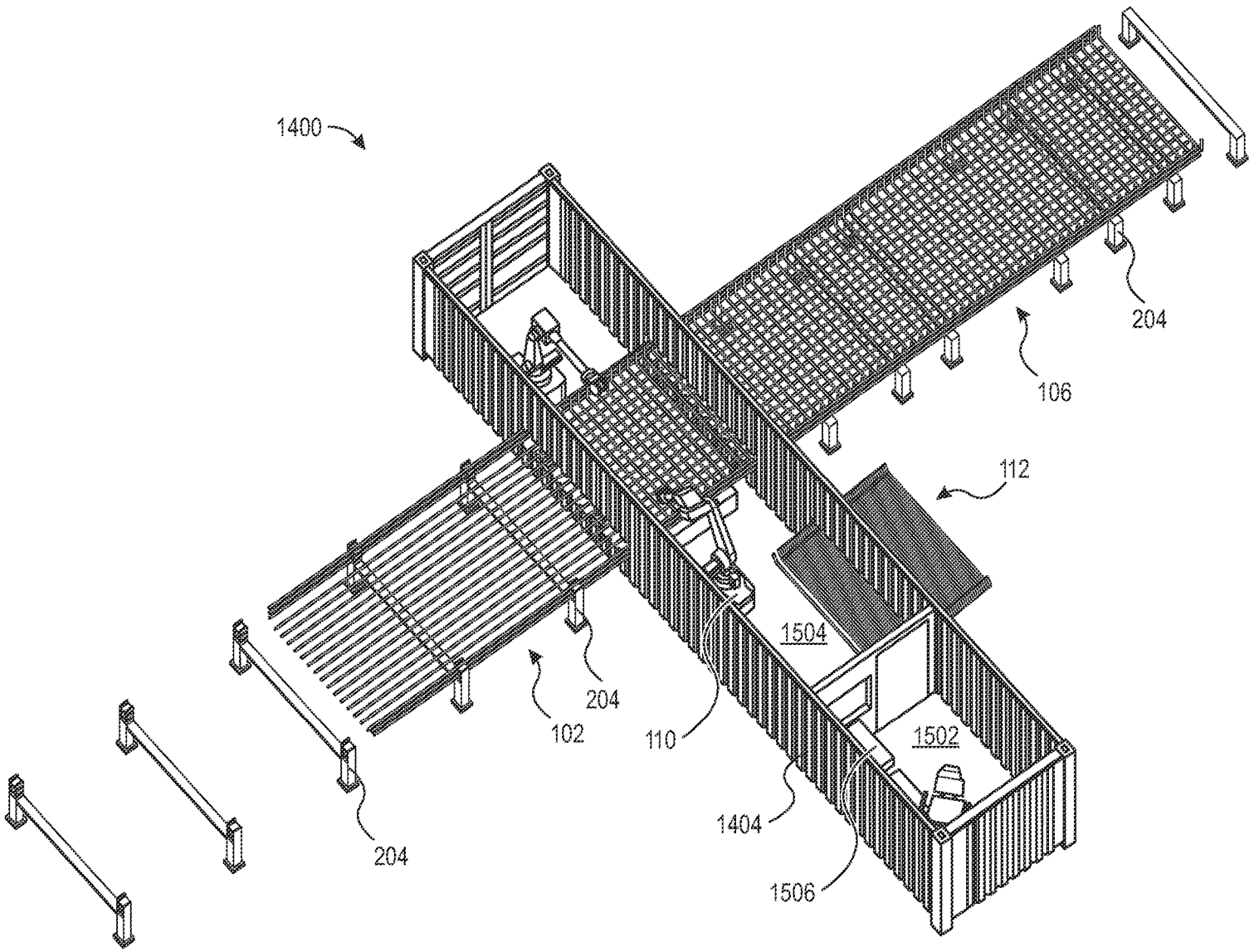
FIG. 15 shows a perspective view illustrating rooms within a mobile robotic rebar structure building system, according to one embodiment of the present disclosure.

FIG. 15 shows a perspective view illustrating rooms within a mobile robotic rebar structure building system 1400, according to one embodiment of the present disclosure. The system may comprise a structure 1404 that is divided into rooms. A construction room 1504 may receive feed rebar 102 from outside the room. The feed rebar 102 may be fed through an adjustable feed matrix that defines vertical and horizontal spacing of the feed rebar 102. One or more robotic arms 110 may select cross rebar from a cross rebar stack 112 and/or couple cross rebar to the feed rebar 102 at configured intervals. The resulting rebar structure 106 may exit the structure 1404 and be supported by supports 204.

The structure 1404 may comprise a control room 1502. The control room 1502 may comprise a control system 1506. The control system 1506 may enable automation of various aspects of the mobile robotic rebar structure building system 1400. For example, the control system 1506 may configure and/or control the robotic arms 110; vertical, horizontal, and/or thickness adjustments of elements of the adjustable feed matrix; feeding of the feed rebar 102 (e.g., starting and stopping, feed rate, total length before cutting, etc.); cutting of feed rebar 102 for total rebar structure size; placement of cross rebar; intervals between cross rebar; coupling type (e.g., tying, welding, etc.); coupling form (e.g., tying knot, weld type, etc.); and/or other configurable or controllable aspects of the mobile robotic rebar structure building system 1400.

Figure 16:
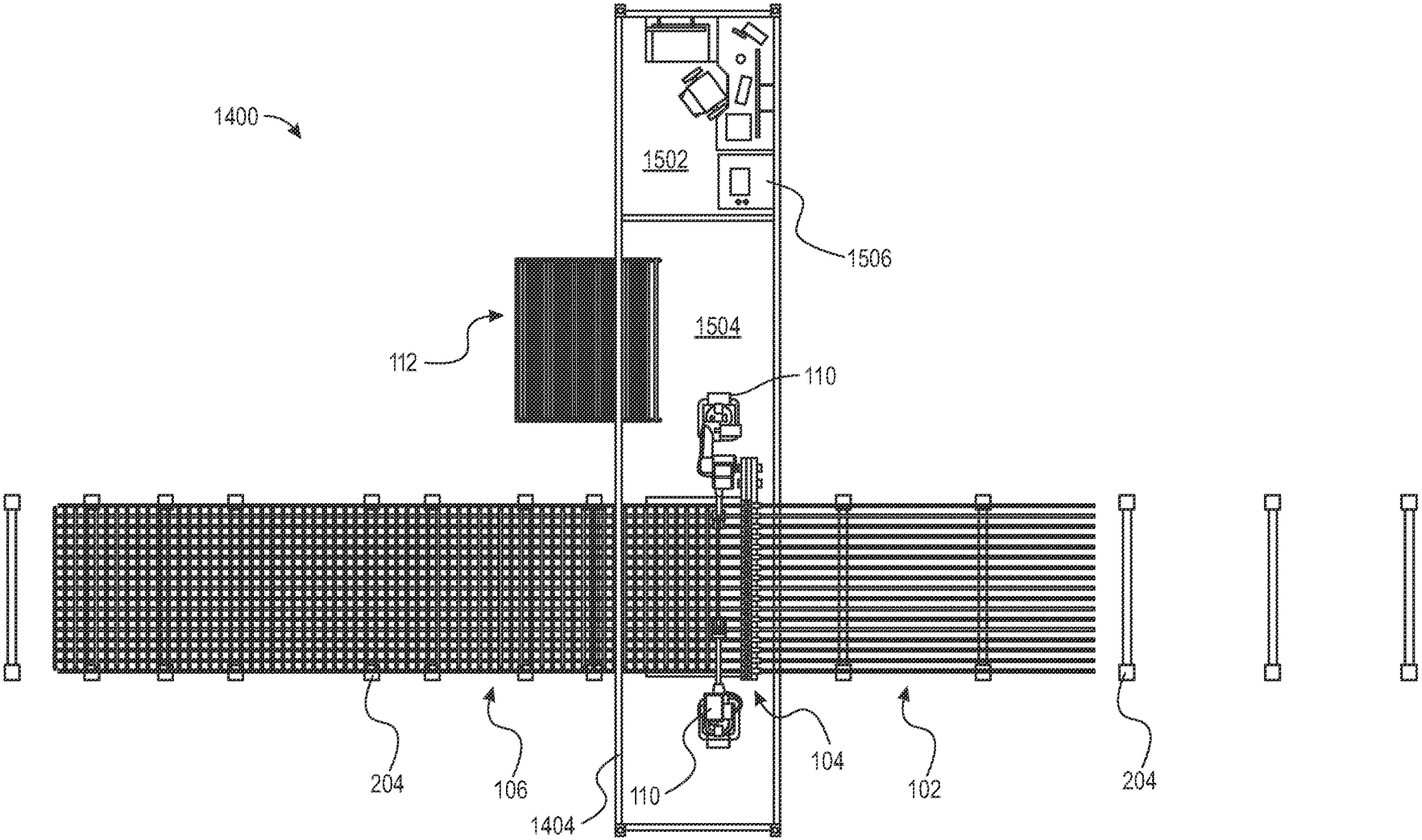
FIG. 16 shows a top view illustrating rooms within a mobile robotic rebar structure building system, according to one embodiment of the present disclosure.

FIG. 16 shows a top view illustrating rooms within a mobile robotic rebar structure building system 1400, according to one embodiment of the present disclosure. An operator in the control room 1502 may configure a control system 1506 to construct a first rebar structure 106. The control system 1506 may send configurations to systems within the construction room 1504. Cross rebar may be loaded in the cross rebar stack 112. Openings in the structure 1404, for the cross rebar, feed rebar 102, and/or first rebar structure 106 to enter and/or exit the structure 1404, may be transitioned from a closed position to an open position. The adjustable feed matrix 104 may be adjusted in horizontal, vertical, and rebar thickness dimensions. Robotic arms 110 may be configured with pre-defined motions. Robotic arms 110 may be loaded with coupling mechanisms (tie guns, wire, welding attachments, etc.), such as at or as end-of-arm tools. Feed rebar 102 may be loaded into the adjustable feed matrix 104. Feeding mechanisms may be configured to move the feed rebar 102 through the adjustable feed matrix 104. Supports 204 for the feed rebar 102 may be placed to support the feed rebar 102 and/or first rebar structure 106. These actions and others may be executed by the control system 1506 and/or manually.

Once the configuration and/or setup is complete, the control system 1506 may execute commands to cause construction of the rebar structure 106 to begin. Feed rebar 102 may be fed through the adjustable feed matrix 104. At configured intervals, robotic arms 110 may place and/or couple cross rebar from the cross rebar stack 112 to the feed rebar 102 that has exited and is held in place by the adjustable feed matrix 104. These operations and/or construction of the first rebar structure 106 may be monitored and/or controlled by control system 1506. Once the first rebar structure 106 is complete, a second rebar structure 106 may be built. Depending on the needs, the mobile robotic rebar structure building system 1400 can build a second rebar structure 106 using the same configuration as the first rebar structure 106. The mobile robotic rebar structure building system 1400 may also be reconfigured to build a second rebar structure 106 with a different configuration than the first rebar structure 106.

Figure 17:
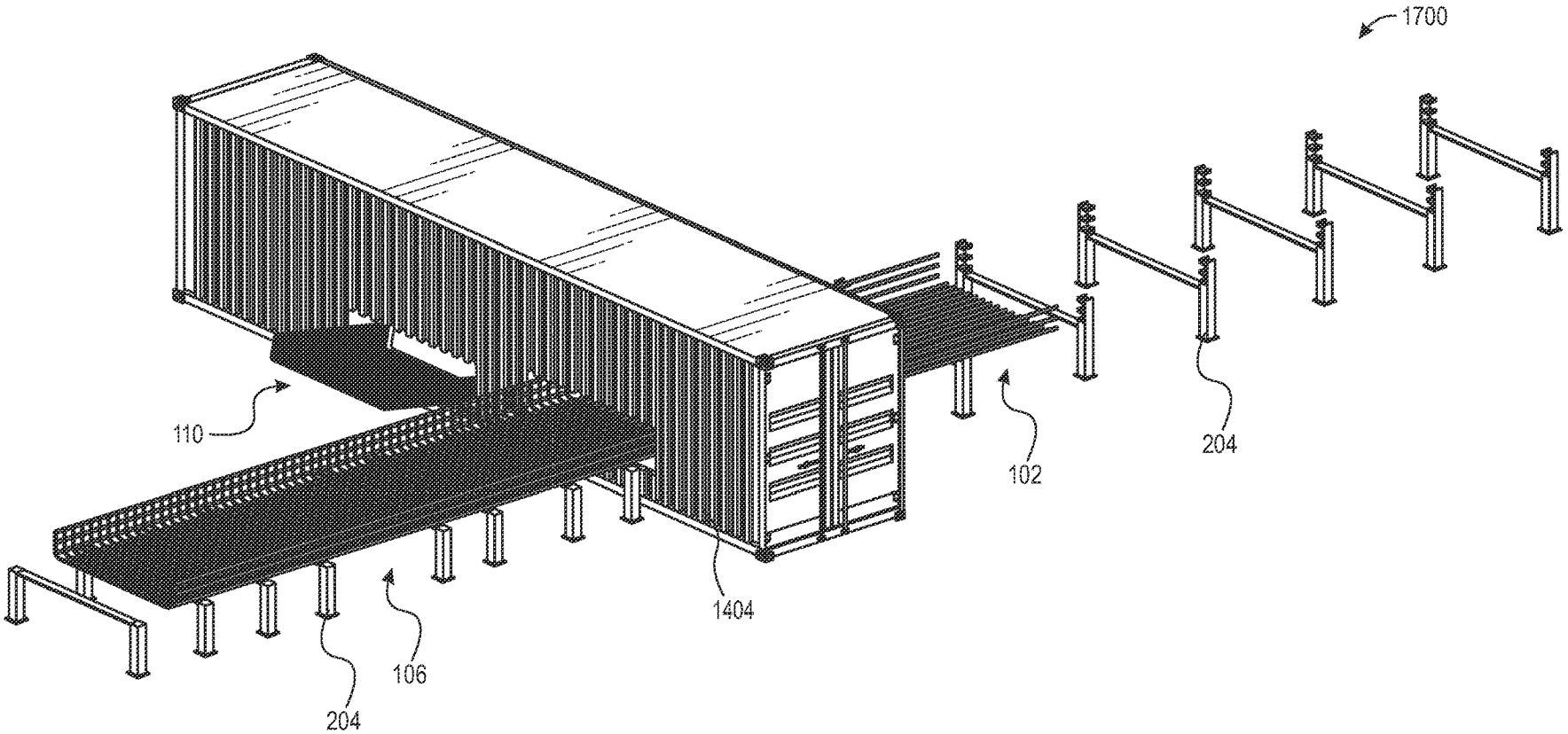
FIG. 17 shows a diagram illustrating a construction site-based robotic rebar structure building system, according to one embodiment of the present disclosure.

FIG. 17 shows a diagram illustrating a construction site-based robotic rebar structure building system 1700, according to one embodiment of the present disclosure. An enclosed structure 1404 provides several advantages. The enclosed structure 1404 enables the mobile robotic rebar structure building system 1400 to be protected from the elements. The enclosed structure 1404 protects the automated and/or sensitive equipment from being tampered with, while providing easy access to load feed rebar 102 and/or cross rebar and/or to discharge the rebar structure 106. Control systems and/or building systems may be fully modularized, such that one shipping container may contain the necessary systems for rebar structure 106 construction. In some embodiments, two shipping containers may be delivered. The first shipping container may comprise the enclosed structure 1404 with the mobile robotic rebar structure building system 1400. The second container may comprise consumables for building the rebar structure 106 (e.g., wire ties, feed rebar, cross rebar, welding gas, welding electrode, welding wire, etc.).

By constructing on-site, transportation costs and delays may be reduced. Transportation costs may be reduced because the components for a rebar structure may be tightly packed and delivered to be assembled on-site, rather than individual rebar structures, which may not be able to be tightly packed. In addition, oversized loads via highway transportation may be reduced. Delays and/or errors may be reduced by customizing the rebar structures on-site as they are needed. For example, with transported rebar structures, the sizing may be anticipated beforehand, and changes may require rebuilding and transportation time. With on-site building, any changes may be incorporated as the rebar structure may be built on-site and as needed. If one section of the site is delayed, the rebar structures may be built for another section, without having rebar structure inventory waiting on the delay.

While the above descriptions have described using pre-configured (e.g., bent, shaped, formed) cross rebar, the system may also cut and/or form cross rebar on-site. Depending on the embodiment, a separate cross rebar forming system may be used, or the robotic arms may be used to form the cross rebar. In one embodiment, the robotic arms form the cross rebar as needed during construction. A robotic arm may cut cross rebar, form the cross rebar into a configured shape, place the cross rebar for coupling to the feed rebar, and couple the shaped cross rebar to the feed rebar.

Figure 18:
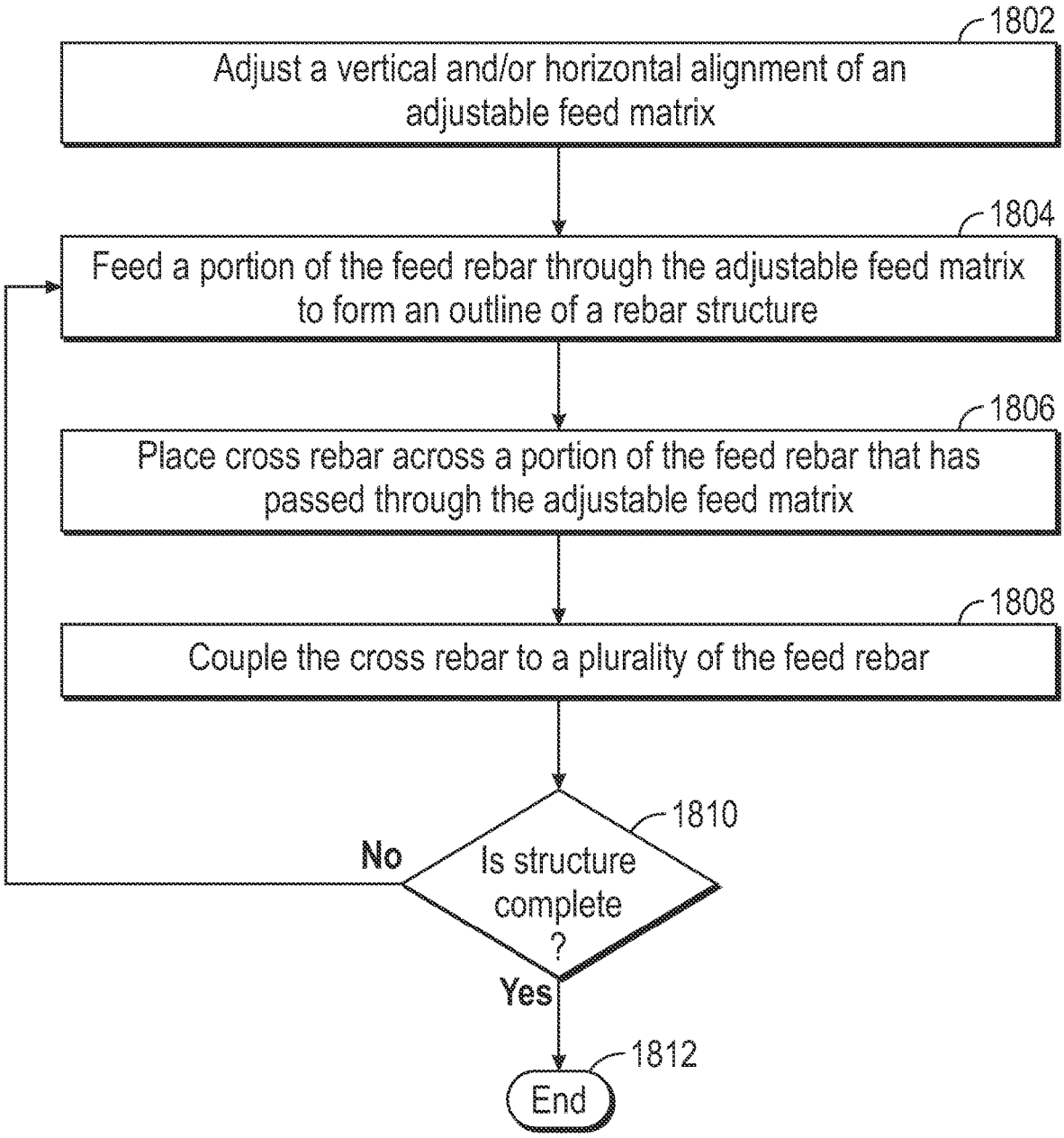
FIG. 18 shows a flowchart of a method for configurable rebar construction, according to one embodiment of the present disclosure.

FIG. 18 shows a flowchart of a method for configurable rebar construction, according to one embodiment of the present disclosure. The method may be performed by systems and/or may involve components described herein, including feed rebar 102, an adjustable feed matrix 104, one or more robotic arm(s) 110, a feed column 202, feed segments 302, feed mechanisms, stabilizing mechanisms, and a control system 1506. In block 1802, a rebar construction system may adjust a vertical and/or horizontal alignment (e.g., positioning, or spacing) of feed columns and/or feed segments an adjustable feed matrix. In block 1804, the rebar construction system may feed a portion of the feed rebar through the adjustable feed matrix to at least partially form an outline of a rebar structure. In block 1806, the rebar construction system may place cross rebar across a portion of the feed rebar that has passed through the adjustable feed matrix. In block 1808, the rebar construction system may couple the cross rebar to a plurality of the feed rebar. In block 1810, if the structure is not complete, the rebar construction system may return to block 1804. In block 1810, if the structure is complete, the rebar construction system may end at block 1812.

Figure 19:
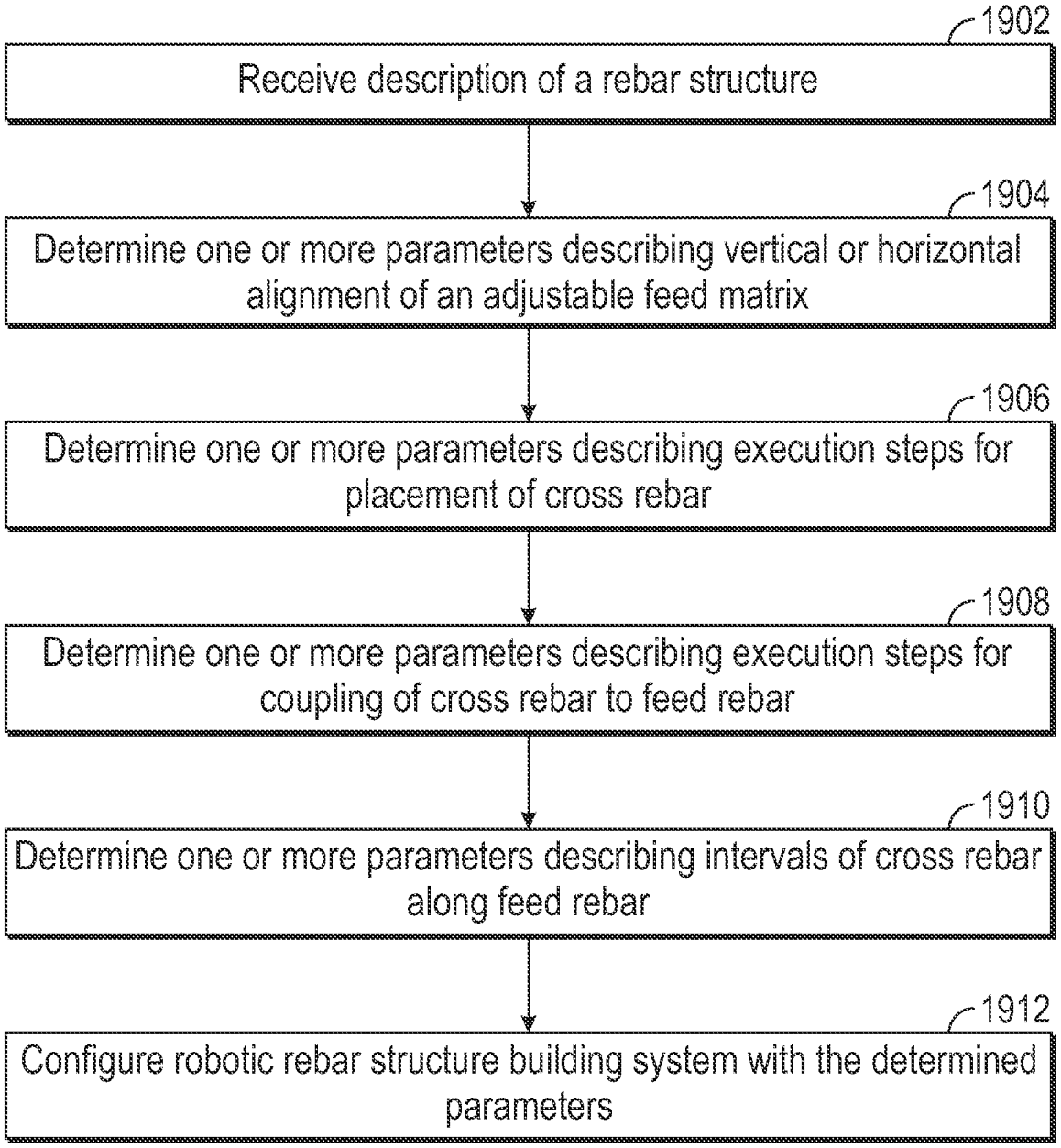
FIG. 19 shows a flowchart of a method for configuring automated rebar construction, according to one embodiment of the present disclosure.

FIG. 19 shows a flowchart of a method for configuring automated rebar construction. The method may be performed by systems and/or components described herein, including feed rebar 102, adjustable feed matrix 104, robotic arm(s) 110, rebar structure 106, feed columns 202, feed segments 302, feed mechanisms, stabilizing mechanisms, and a control system 1506. In block 1902, a control system of a rebar construction system may receive a description of a rebar structure. In block 1904, the control system of a rebar construction system may determine one or more parameters describing vertical or horizontal alignment of an adjustable feed matrix. In block 1906, the control system of a rebar construction system may determine one or more parameters describing execution steps for placement of cross rebar. In block 1908, the control system of a rebar construction system may determine one or more parameters describing execution steps for coupling of cross rebar to feed rebar. In block 1910, the control system of a rebar construction system may determine one or more parameters describing intervals of cross rebar along feed rebar. In block 1912, the control system of a rebar construction system may configure a robotic rebar structure building system with the determined parameters.

Figure 20:
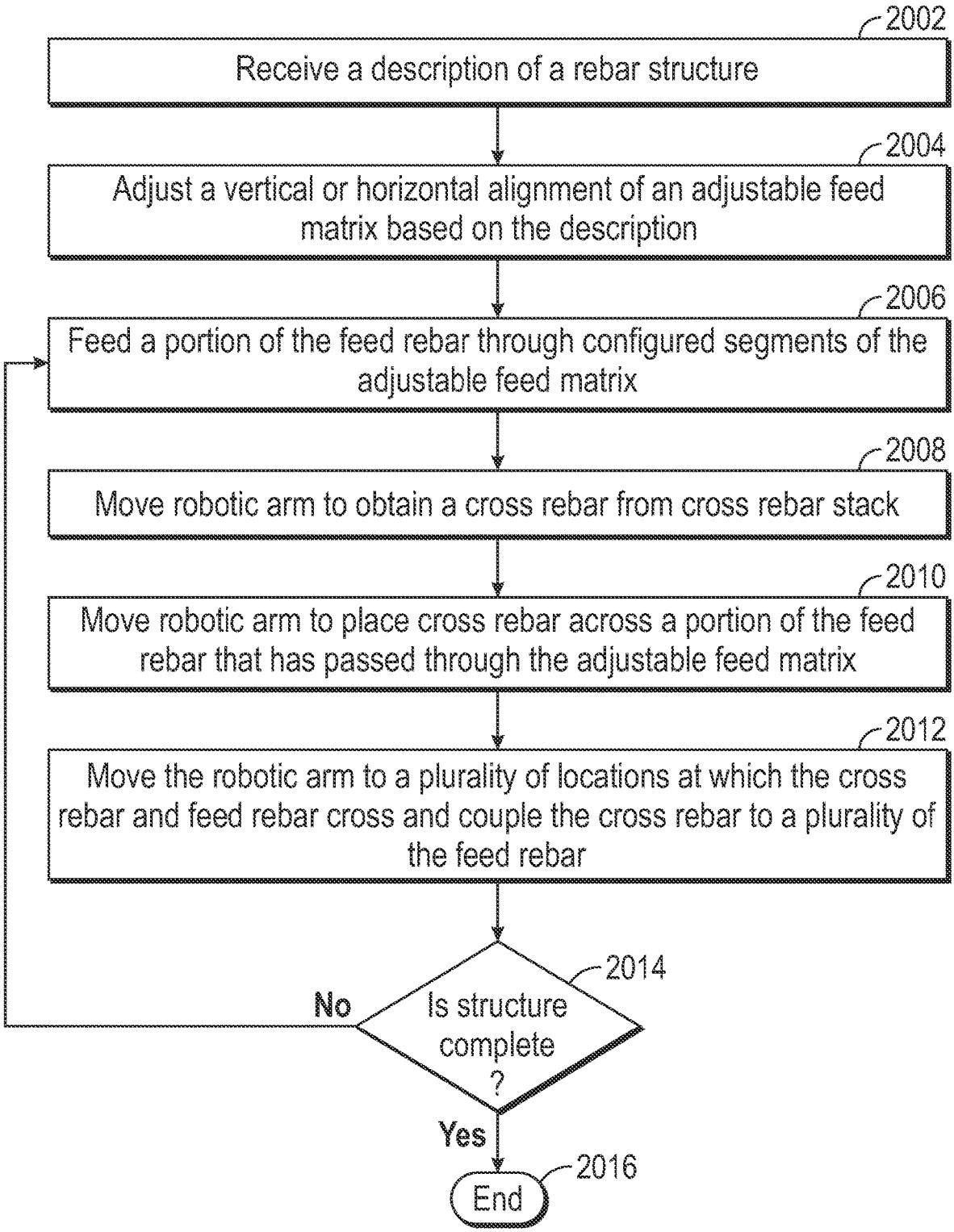
FIG. 20 shows a flowchart of a method for automated rebar construction, according to one embodiment of the present disclosure.

FIG. 20 shows a flowchart of a method for automated rebar construction. The method may be performed by systems and/or components described herein, including feed rebar 102, adjustable feed matrix 104, robotic arm(s) 110, rebar structure 106, feed columns 202, feed segments 302, feed mechanisms, stabilizing mechanisms, and a control system 1506. In block 2002, a control system of a rebar construction system may receive a description of a rebar structure. In block 2004, the control system of a rebar construction system may adjust a vertical or horizontal alignment of an adjustable feed matrix based on the description. In block 2006, the control system of a rebar construction system may feed a portion of the feed rebar through configured segments of the adjustable feed matrix. In block 2008, the control system of a rebar construction system may move a robotic arm to obtain a cross rebar from a cross rebar stack. In block 2010, the control system of a rebar construction system may move the robotic arm to place cross rebar across a portion of the feed rebar that has passed through the adjustable feed matrix. In block 2012, the control system of a rebar construction system may move the robotic arm to a plurality of locations at which the cross rebar and feed rebar cross and couple the cross rebar to a plurality of the feed rebar. In block 2014, if the structure is not complete, the rebar construction system may return to block 2006. In block 2014, if the structure is complete, the rebar construction system may stop at block 2016.

Figure 21:
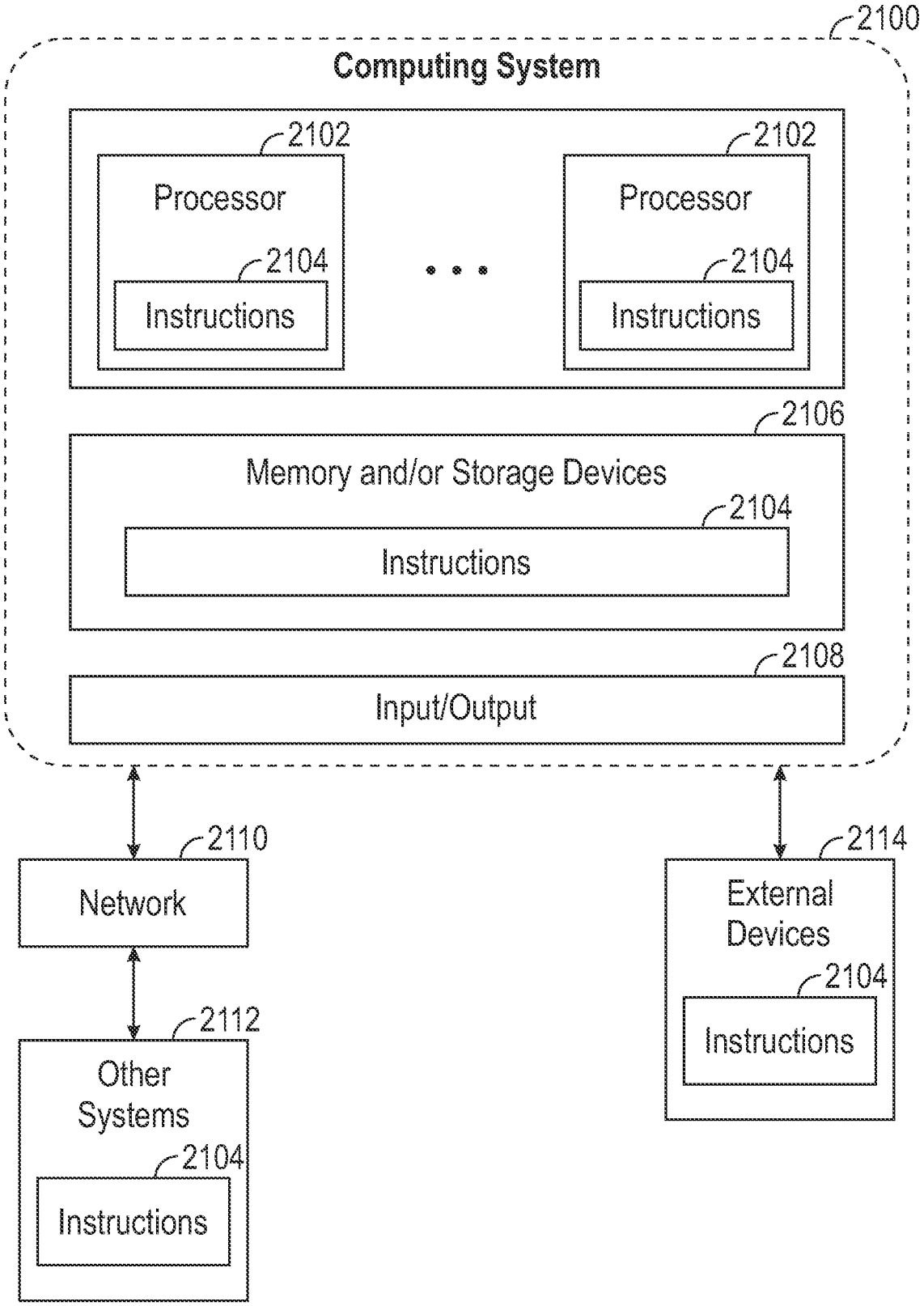
FIG. 21 is a block diagram illustrating a computing system and components of a robotic rebar structure building system, according to one embodiment of the present disclosure.

FIG. 21 is a block diagram illustrating components, according to some example embodiments, able to read instructions from a machine-readable or computer-readable medium (e.g., a machine-readable storage medium) and perform any one or more of the methodologies discussed herein. Specifically, FIG. 21 shows a diagrammatic representation of hardware resources (e.g., a computing system) 2100 including one or more processors (or processor cores) 2102, and one or more memory/storage devices 2106.

The processors 2102 may comprise one or more of a central processing unit (CPU), a reduced instruction set computing (RISC) processor, a complex instruction set computing (CISC) processor, a graphics processing unit (GPU), a digital signal processor (DSP) such as a baseband processor, an application specific integrated circuit (ASIC), a radio-frequency integrated circuit (RFIC), another processor, or any suitable combination thereof. The memory/storage devices 2106 may include main memory, disk storage, or any suitable combination thereof.

The input/output resources 2108 may include interconnection and/or network interface components or other suitable devices to communicate with one or more peripheral devices and/or one or more databases via a network 2110. For example, the input/output resources 2108 may include wired communication components (e.g., for coupling via a Universal Serial Bus (USB)), cellular communication components, Near Field Communication (NFC) components, Bluetooth® components (e.g., Bluetooth® Low Energy), Wi-Fi® components, and other communication components. The input/output resources 2108 may also include interconnection with one or more external devices 2114.

Instructions 2104 may comprise software, a program, an application, an applet, an app, or other executable code for causing at least any of the processors 2102 to perform any one or more of the methodologies discussed herein. The instructions 2104 may reside, completely or partially, within at least one of the processors 2102 (e.g., within the processor's cache memory), the memory/storage devices 2106, or any suitable combination thereof. Furthermore, any portion of the instructions 2104 may be transferred to the hardware resources 2100 from any combination of the peripheral devices and/or the databases. Accordingly, the memory of processors 2102 of the memory/storage devices 2106, the peripheral devices, and the databases are examples of computer-readable and machine-readable media.

EXAMPLES

Some examples of embodiments of the present disclosure are now provided.

Example 1. An apparatus for feeding rebar (e.g., for assembling a rebar structure), the apparatus comprising: a feed column comprising a plurality of feed segments, each feed segment comprising: a feeding cavity defined through the feed segment and configured to direct a length of rebar from an input (of the feeding cavity) and to an output (of the feeding cavity) at a configurable height as measured from a feeding cavity of another feed segment of the plurality of feed segments; a configurable rebar feed configured to feed the length of rebar through the feeding cavity; a coupling coupled to the feed column and configured to removably couple to a rail; a horizontal adjustment configured to decouple the coupling from the rail when deactivated and securely recouple the coupling to the rail when activated, wherein the feed column is movable along the rail when the coupling is decoupled; and a vertical adjustment configured to adjust a height between adjacent outputs of feeding cavities of adjacent feed segments of the plurality of feed segments of the feed column.

Example 2. The apparatus of claim 1, wherein the rebar feed comprises two discs positioned at opposing sides of the length of rebar, each disc comprising concave edges to engage the length of rebar.

Example 3. The apparatus of Example 2, wherein the two discs are spring-loaded to accommodate varying thicknesses of rebar.

Example 4. The apparatus of Example 2, wherein the two discs are motorized to automatically move the length of rebar through the feeding cavity.

Example 5. The apparatus of Example 1, wherein the rebar feed comprises two rollers positioned at opposing sides of the length of rebar.

Example 6. The apparatus of Example 1, wherein the plurality of feed segments are arranged in vertical alignment within the feed column.

Example 7. The apparatus of Example 1, wherein the rebar feed is configured to accommodate and feed different thicknesses of rebar through the feeding cavity.

Example 8. The apparatus of Example 1, further comprising a second feed column comprising a second plurality of feed segments, wherein the feeding cavity of each feed segment of the plurality of feed segments is further to direct the length of rebar from the input to the output at a configurable width as measured from a feeding cavity of a feed segment of the second plurality of feed segments.

Example 9. The apparatus of Example 8, where in the plurality of feed segments and the second plurality of feed segments feed a plurality of lengths of rebar arranged to functionally enclose a central area.

Example 10. The apparatus of Example 1, wherein the coupling is fixedly coupled to the feed column.

Example 11. An apparatus for feeding rebar, the apparatus comprising: a plurality of feed columns (e.g., arranged to form an adjustable feed matrix), each feed column of the plurality of feed columns comprising: one or more feed segments to feed rebar for assembling a rebar structure, each feed segment comprising a rebar support within the feed segment configured to direct a length of feed rebar from an input and to an output at one or more of a configurable height and width as measured from an adjacent feed segment; and an adjustment mechanism configured to adjust one or more of a horizontal distance and a vertical distance between a given feed segment and an adjacent feed segment.

Example 12. The apparatus of Example 11, wherein the adjustment mechanism comprises a horizontal adjustment mechanism for adjusting a horizontal position of the feed column to an adjacent feed column of the plurality of feed columns.

Example 13. The apparatus of Example 12, wherein the horizontal adjustment mechanism comprises a releasable clamp configured to activate to secure the feed column to a rail and to deactivate to release the feed column to move along the rail.

Example 14. The apparatus of Example 11, wherein the adjustment mechanism comprises a vertical adjustment mechanism for adjusting a vertical position of a feed segment of the one or more feed segments relative to the adjacent feed segment that is also one of the one or more feed segments of the feed column.

Example 15. The apparatus of Example 11, wherein the vertical adjustment mechanism comprises a screw-driven mechanism configured to adjust a vertical position of the one or more feed segments of the feed column.

Example 16. The apparatus of Example 11, wherein the rebar support comprises a feeding cavity defined through the feed segment and configured to direct a length of rebar from the input and to the output.

Example 17. The apparatus of Example 11, wherein each feed segment comprises a rebar feed configured to feed the length of feed rebar through the rebar support.

Example 18. The apparatus of Example 11, wherein the rebar feed comprises two discs positioned at opposing sides of the length of rebar, each disc comprising concave edges to engage the length of rebar.

Example 19. The apparatus of Example 11, wherein the rebar feed comprises two rollers positioned at opposing sides of the length of rebar.

Example 20. The apparatus of Example 11, wherein the rebar feed is motorized to automatically move the length of rebar through the rebar support.

Example 21. A system for constructing rebar structures, the apparatus comprising: a configurable array of feed columns, each feed column (of the configurable array of feed columns) comprising one or more feed segments each to feed a length of rebar for assembly of a rebar structure, wherein the feed columns are configured to be adjustable with respect to one or more of rebar horizontal placement and rebar vertical placement, the configurable array to provide a plurality of feed rebar for the rebar structure; and a robotic arm configured to couple, at configured lengths of a feed rebar, cross rebar to the plurality of feed rebar to assemble the rebar structure.

Example 22. The system of Example 21, further comprising: a control system communicatively coupled to the robotic arm, the control system configurable to control cross rebar placement along a length of the plurality of the feed rebar.

Example 23. The system of Example 22, wherein the control system is further communicatively coupled to the configurable array of feed columns, the control system configurable to adjust the configurable array for one or more of rebar horizontal placement and rebar vertical placement of each feed rebar of the plurality of feed rebar.

Example 24. The system of Example 23, wherein the control system is further configurable to adjust the configurable array of feed columns for rebar thickness.

Example 25. The system of Example 21, further comprising: A control system communicatively coupled to the robotic arm and the configurable array of feed columns, the control system configurable to: control cross rebar placement along a length of the plurality of the feed rebar; and adjust the configurable array for rebar horizontal placement and rebar vertical placement of each feed rebar of the plurality of feed rebar.

Example 26. The system of Example 21, wherein the robotic arm is to: position the cross rebar for securing to the plurality of feed rebar; and apply a coupling to secure the cross rebar to the plurality of feed rebar to assemble the rebar structure.

Example 27. The system of Example 21, wherein the robotic arm is further to: shape the cross rebar for coupling to the plurality of feed rebar.

Example 28. The system of Example 21, wherein the feed segments each comprise: a feeding cavity defined through the feed segment and configured to direct a first length of rebar from an input of the feeding cavity and to an output of the feeding cavity at a configurable height as measured from a feeding cavity of another feed segment of the plurality of feed segments; and a rebar feed configured to feed rebar through the feeding cavity.

Example 29. The system of Example 21, wherein the plurality of feed rebar and cross rebar are arranged to functionally enclose a central area.

Example 30. The system of Example 21, further comprising a mobile enclosure enclosing the configurable array of feed columns, the robotic arm, and the control system.

Example 31. An apparatus for constructing cage rebar structures, the apparatus comprising: an adjustable feed matrix configured to feed a plurality of feed rebar arranged to functionally enclose a central area, the adjustable feed matrix comprising a plurality of feed segments each to deliver feed rebar of the plurality of feed rebar and each adjustable vertically and horizontally relative to an adjacent feed segment; one or more robotic arms configured to couple cross rebar at lengths along the plurality of feed rebar, wherein the cross rebar is oriented in a direction transverse to the plurality of feed rebar; and a control system to control positioning of the plurality of feed segments and cross rebar placement to form a lattice along the plurality of feed rebar from the adjustable feed matrix.

Example 32. The apparatus of Example 31, wherein the cross rebar is positioned to at least partially enclose the plurality of feed rebar (and the central area).

Example 33. A mobile rebar structure building system for constructing rebar structures, the system comprising: a mobile enclosure to house the mobile rebar structure building system and comprising an input aperture and an output aperture; an adjustable feed matrix positioned within the mobile enclosure and configured to receive a plurality of feed rebar through the input aperture of the mobile enclosure and feed the plurality of feed rebar for assembly of a rebar structure, wherein the adjustable feed matrix comprises a plurality of feed segments each to deliver feed rebar of the plurality of feed rebar and each adjustable vertically and horizontally relative to an adjacent feed segment; and one or more robotic arms configured to couple cross rebar to the plurality of feed rebar as provided from the adjustable feed matrix, wherein the cross rebar is oriented in a direction transverse to the plurality of feed rebar to form a lattice rebar structure, wherein the lattice rebar structure exits the mobile enclosure through the output aperture.

Example 34. The mobile rebar structure building system of Example 33, further comprising: a control system to control positioning of the plurality of feed segments of the adjustable feed matrix and to control cross rebar placement to form the lattice rebar structure.

As used herein, the term "circuitry" may refer to, be part of, or include an application specific integrated circuit (ASIC), an electronic circuit, a processor (shared, dedicated, or group), and/or memory (shared, dedicated, or group) that execute one or more software or firmware programs, a combinational logic circuit, and/or other suitable hardware components that provide the described functionality. In some embodiments, the circuitry may be implemented in, or functions associated with the circuitry may be implemented by, one or more software or firmware modules. In some embodiments, circuitry may include logic, at least partially operable in hardware.

Embodiments and implementations of the systems and methods described herein may include various operations, which may be embodied in machine-executable instructions to be executed by a computer system. A computer system may include one or more general-purpose or special purpose computers (or other electronic devices). The computer system may include hardware components that include specific logic for performing the operations or may include a combination of hardware, software, and/or firmware.

Computer systems and the computers in a computer system may be connected via a network. Suitable networks for configuration and/or use as described herein include one or more local area networks, wide area networks, metropolitan area networks, and/or Internet or IP networks, such as the World Wide Web, a private Internet, a secure Internet, a value-added network, a virtual private network, an extranet, an intranet, or even stand-alone machines which communicate with other machines by physical transport of media. In particular, a suitable network may be formed from parts or entireties of two or more other networks, including networks using disparate hardware and network communication technologies.

One suitable network includes a server and one or more clients; other suitable networks may contain other combinations of servers, clients, and/or peer-to-peer nodes, and a given computer system may function both as a client and as a server. Each network includes at least two computers or computer systems, such as the server and/or clients. A computer system may include a workstation, laptop computer, disconnectable mobile computer, server, mainframe, cluster, so-called "network computer" or "thin client," tablet, smart phone, personal digital assistant or other hand-held computing device, "smart" consumer electronics device or appliance, or a combination thereof.

Suitable networks may include communications or networking software, such as the software available from Novell®, Microsoft®, and other vendors, and may operate using TCP/IP, SPX, IPX, and other protocols over twisted pair, coaxial, or optical fiber cables, telephone lines, radio waves, satellites, microwave relays, modulated AC power lines, physical media transfer, and/or other data transmission "wires" known to those of skill in the art. The network may encompass smaller networks and/or be connectable to other networks through a gateway or similar mechanism.

Various techniques, or certain aspects or portions thereof, may take the form of program code (i.e., instructions) embodied in tangible media, such as floppy diskettes, CD-ROMs, hard drives, magnetic or optical cards, solid-state memory devices, a nontransitory computer-readable storage medium, or any other machine-readable storage medium wherein, when the program code is loaded into and executed by a machine such as a computer, the machine becomes an apparatus for practicing the various techniques. In the case of program code execution on programmable computers, the computing device may include a processor, a storage medium readable by the processor (including volatile and nonvolatile memory and/or storage elements), at least one input device, and at least one output device. The volatile and nonvolatile memory and/or storage elements may be a RAM, an EPROM, a flash drive, an optical drive, a magnetic hard drive, or other medium for storing electronic data. One or more programs that may implement or utilize the various techniques described herein may use an application programming interface (API), reusable controls, and the like. Such programs may be implemented in a high-level procedural or an object-oriented programming language to communicate with a computer system. However, the program(s)

may be implemented in assembly or machine language, if desired. In any case, the language may be a compiled or interpreted language, and combined with hardware implementations.

Each computer system includes one or more processors and/or memory; computer systems may also include various input devices and/or output devices. The processor may include a general-purpose device, such as an Intel®, AMD®, or other "off-the-shelf" microprocessor. The processor may include a special purpose processing device, such as ASIC, SoC, SiP, FPGA, PAL, PLA, FPLA, PLD, or other customized or programmable device. The memory may include static RAM, dynamic RAM, flash memory, one or more flip-flops, ROM, CD-ROM, DVD, disk, tape, or magnetic, optical, or other computer storage medium. The input device(s) may include a keyboard, mouse, touch screen, light pen, tablet, microphone, sensor, or other hardware with accompanying firmware and/or software. The output device(s) may include a monitor or other display, printer, speech or text synthesizer, switch, signal line, or other hardware with accompanying firmware and/or software.

It should be understood that many of the functional units described in this specification may be implemented as one or more components, which is a term used to more particularly emphasize their implementation independence. For example, a component may be implemented as a hardware circuit comprising custom very large scale integration (VLSI) circuits or gate arrays, or off-the-shelf semiconductors such as logic chips, transistors, or other discrete components. A component may also be implemented in programmable hardware devices such as field programmable gate arrays, programmable array logic, programmable logic devices, or the like.

Components may also be implemented in software for execution by various types of processors. An identified component of executable code may, for instance, comprise one or more physical or logical blocks of computer instructions, which may, for instance, be organized as an object, a procedure, or a function. Nevertheless, the executables of an identified component need not be physically located together, but may comprise disparate instructions stored in different locations that, when joined logically together, comprise the component and achieve the stated purpose for the component.

Indeed, a component of executable code may be a single instruction, or many instructions, and may even be distributed over several different code segments, among different programs, and across several memory devices. Similarly, operational data may be identified and illustrated herein within components, and may be embodied in any suitable form and organized within any suitable type of data structure. The operational data may be collected as a single data set, or may be distributed over different locations including over different storage devices, and may exist, at least partially, merely as electronic signals on a system or network. The components may be passive or active, including agents operable to perform desired functions.

Several aspects of the embodiments described will be illustrated as software modules or components. As used herein, a software module or component may include any type of computer instruction or computer-executable code located within a memory device. A software module may, for instance, include one or more physical or logical blocks of computer instructions, which may be organized as a routine, program, object, component, data structure, etc., that perform one or more tasks or implement particular data types. It is appreciated that a software module may be implemented in hardware and/or firmware instead of or in addition to software. One or more of the functional modules described herein may be separated into sub-modules and/or combined into a single or smaller number of modules.

In certain embodiments, a particular software module may include disparate instructions stored in different locations of a memory device, different memory devices, or different computers, which together implement the described functionality of the module. Indeed, a module may include a single instruction or many instructions, and may be distributed over several different code segments, among different programs, and across several memory devices. Some embodiments may be practiced in a distributed computing environment where tasks are performed by a remote processing device linked through a communications network. In a distributed computing environment, software modules may be located in local and/or remote memory storage devices. In addition, data being tied or rendered together in a database record may be resident in the same memory device, or across several memory devices, and may be linked together in fields of a record in a database across a network.

Reference throughout this specification to "an example" means that a particular feature, structure, or characteristic described in connection with the example is included in at least one embodiment of the present invention. Thus, appearances of the phrase "in an example" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on its presentation in a common group without indications to the contrary. In addition, various embodiments and examples of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the preceding description, numerous specific details are provided, such as examples of materials, frequencies, sizes, lengths, widths, shapes, etc., to provide a thorough understanding of embodiments of the invention. One skilled in the relevant art will recognize, however, that the invention may be practiced without one or more of the specific details, or with other methods, components, materials, etc. In other instances, well-known structures, materials, or operations are not shown or described in detail to avoid obscuring aspects of the invention.

It should be recognized that the systems described herein include descriptions of specific embodiments. These embodiments can be combined into single systems, partially combined into other systems, split into multiple systems or divided or combined in other ways. In addition, it is contemplated that parameters/attributes/aspects/etc. of one embodiment can be used in another embodiment. The parameters/attributes/aspects/etc. are merely described in one or more embodiments for clarity, and it is recognized that the parameters/attributes/aspects/etc. can be combined with or substituted for parameters/attributes/aspects/etc. of another embodiment unless specifically disclaimed herein.

Although the foregoing has been described in some detail for purposes of clarity, it will be apparent that certain changes and modifications may be made without departing from the principles thereof. It should be noted that there are many alternative ways of implementing both the processes and apparatuses described herein. Accordingly, the present embodiments are to be considered illustrative and not restrictive, and the invention is not to be limited to the details given herein, but may be modified within the scope and equivalents of the appended claims.

Those having skill in the art will appreciate that many changes may be made to the details of the above-described embodiments without departing from the underlying principles of the invention. The scope of the present invention should, therefore, be determined only by the following claims.

What is claimed is:

1. An apparatus for feeding rebar, the apparatus comprising:

a feed column comprising a plurality of vertically arranged feed segments, each feed segment comprising:

a feeding cavity defined through that feed segment and configured to direct a length of rebar from an input and to an output at a configurable height as measured from a feeding cavity of another feed segment of the plurality of vertically arranged feed segments;

a rebar feed configured to feed the length of rebar through the feeding cavity;

a coupling coupled to the feed column and configured to removably couple to a rail;

a horizontal adjustment configured to decouple the coupling from the rail when deactivated and securely recouple the coupling to the rail when activated, wherein the feed column is movable along the rail when the coupling is decoupled; and a vertical adjustment configured to individually adjust a height between vertically adjacent outputs of feeding cavities of vertically adjacent feed segments of the plurality of vertically arranged feed segments of the feed column, wherein the vertical adjustment is performed via a computer controlled hydraulic system, wherein the computer controlled hydraulic system is configured to adjust hydraulic spaces within the plurality of vertically arranged feed segments that are filled with a hydraulic fluid, and wherein individual feed segments are addressable via hydraulic fluid distribution.

2. The apparatus of claim 1, wherein the rebar feed comprises two discs positioned at opposing sides of the length of rebar, each disc comprising concave edges to engage the length of rebar.

3. The apparatus of claim 2, wherein the two discs are spring-loaded to accommodate varying thicknesses of rebar.

4. The apparatus of claim 2, wherein the two discs are motorized to automatically move the length of rebar through the feeding cavity.

5. The apparatus of claim 1, wherein the rebar feed comprises two rollers positioned at opposing sides of the length of rebar.

6. The apparatus of claim 1, wherein the plurality of vertically arranged feed segments are arranged in vertical alignment within the feed column.

7. The apparatus of claim 1, wherein the rebar feed is configured to accommodate and feed different thicknesses of rebar through the feeding cavity.

8. The apparatus of claim 1, further comprising a second feed column comprising a second plurality of feed segments, wherein the feeding cavity of each feed segment of the plurality of vertically arranged feed segments is further to direct the length of rebar from the input to the output at a configurable width as measured from a feeding cavity of a feed segment of the second plurality of feed segments.

9. The apparatus of claim 8, where in the plurality of vertically arranged feed segments and the second plurality of feed segments feed a plurality of lengths of rebar arranged to functionally enclose a central area.

10. The apparatus of claim 1, wherein the coupling is fixedly coupled to the feed column.

11. An apparatus for feeding rebar, the apparatus comprising:

a plurality of feed columns, each feed column of the plurality of feed columns comprising:

one or more feed segments to feed rebar for assembling a rebar structure, each feed segment comprising a rebar support within that feed segment configured to direct a length of feed rebar from an input and to an output at one or more of an individually configurable height and width as measured from an adjacent feed segment; and an adjustment mechanism configured to individually adjust one or more of a horizontal distance and a vertical distance between a given feed segment and a vertically adjacent feed segment, wherein the adjustment mechanism comprises a computer controlled hydraulic system, wherein the computer controlled hydraulic system is configured to adjust hydraulic spaces within the one or more feed segments that are filled with a hydraulic fluid, and wherein individual feed segments are addressable via hydraulic fluid distribution.

12. The apparatus of claim 11, wherein the adjustment mechanism comprises a horizontal adjustment mechanism for adjusting a horizontal position of a feed column to an adjacent feed column of the plurality of feed columns.

13. The apparatus of claim 12, wherein the horizontal adjustment mechanism comprises a releasable clamp configured to activate to secure the feed column to a rail and to deactivate to release the feed column to move along the rail.

14. The apparatus of claim 11, wherein the adjustment mechanism comprises a vertical adjustment mechanism for adjusting a vertical position of a feed segment of the one or more feed segments relative to the adjacent feed segment that is also one of the one or more feed segments of a feed column.

15. The apparatus of claim 14, wherein the vertical adjustment mechanism comprises a screw-driven mechanism configured to adjust a vertical position of the one or more feed segments of a feed column.

16. The apparatus of claim 14, wherein the rebar support comprises a feeding cavity defined through a feed segment and configured to direct a length of rebar from the input and to the output.

17. The apparatus of claim 11, wherein each feed segment comprises a rebar feed configured to feed the length of feed rebar through the rebar support.

18. The apparatus of claim 17, wherein the rebar feed comprises two discs positioned at opposing sides of the length of rebar, each disc comprising concave edges to engage the length of rebar.

19. The apparatus of claim 17, wherein the rebar feed comprises two rollers positioned at opposing sides of the length of rebar.

20. The apparatus of claim 17, wherein the rebar feed is motorized to automatically move the length of rebar through the rebar support.

* * * * *